US008777354B2

(12) United States Patent
Kubota et al.

(10) Patent No.: US 8,777,354 B2
(45) Date of Patent: Jul. 15, 2014

(54) METHOD FOR MANUFACTURING PRINTING DEVICE, PRINTING DEVICE, AND PRINTING METHOD

(75) Inventors: Mai Kubota, Nagano (JP); Naoki Sudo, Nagano (JP); Akito Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 550 days.

(21) Appl. No.: 13/089,718

(22) Filed: Apr. 19, 2011

(65) Prior Publication Data

US 2011/0285774 A1 Nov. 24, 2011

(30) Foreign Application Priority Data

May 18, 2010 (JP) ..... 2010-114088

(51) Int. Cl.
*B41J 29/38* (2006.01)
*B41J 29/393* (2006.01)
*B41J 2/045* (2006.01)

(52) U.S. Cl.
CPC ..... *B41J 29/393* (2013.01); *B41J 2/04591* (2013.01); *B41J 2/0459* (2013.01); *B41J 2/04535* (2013.01); *B41J 2/04536* (2013.01); *B41J 2/04558* (2013.01)
USPC ..... 347/14; 347/9; 347/10; 347/19

(58) Field of Classification Search
CPC ..... B41J 2/17546; B41J 2202/02; B41J 2/14; B41J 19/202; B41J 2/1752; B41J 2202/20
USPC ..... 347/14, 5, 6, 9, 10, 19, 21, 37, 40, 43, 347/41, 100
See application file for complete search history.

(56) References Cited

U.S. PATENT DOCUMENTS

| | | | | |
|---|---|---|---|---|
| 5,425,134 | A * | 6/1995 | Ishida | 358/1.9 |
| 5,898,208 | A * | 4/1999 | Miyazaki et al. | 349/106 |
| 6,045,210 | A * | 4/2000 | Suzuki et al. | 347/19 |
| 6,179,402 | B1 * | 1/2001 | Suzuki et al. | 347/19 |
| 6,328,400 | B1 * | 12/2001 | Yonekubo et al. | 347/15 |
| 6,336,705 | B1 | 1/2002 | Torigoe | |
| 6,540,329 | B1 | 4/2003 | Kaneko et al. | |
| 6,547,352 | B1 | 4/2003 | Ikeda | |
| 6,607,261 | B1 * | 8/2003 | Shimada | 347/19 |
| 6,692,096 | B1 * | 2/2004 | Otsuki et al. | 347/14 |
| 6,705,702 | B2 * | 3/2004 | Gunther et al. | 347/43 |

(Continued)

FOREIGN PATENT DOCUMENTS

| | | |
|---|---|---|
| EP | 0935213 A2 | 8/1999 |
| EP | 0925931 B1 | 7/2007 |

(Continued)

OTHER PUBLICATIONS

Extended European Search Report dated Aug. 11, 2011 for the corresponding European Patent Application No. 10187246.3.

*Primary Examiner* — Laura Martin
*Assistant Examiner* — Leonard S Liang
(74) *Attorney, Agent, or Firm* — Global IP Counselors, LLP

(57) ABSTRACT

A method for manufacturing a printing device, wherein the printing device uses ink including pigment ink and dye ink to form a printed image on a print medium, and discharges an ink quantity according to a voltage value of a drive voltage to form ink dots on the print medium. In this printing device, the voltage value of the drive voltage for creating ink dots is corrected.

7 Claims, 15 Drawing Sheets

(56) References Cited

U.S. PATENT DOCUMENTS

| | | | | |
|---|---|---|---|---|
| 6,827,423 | B1 * | 12/2004 | Katakura et al. | 347/40 |
| 6,860,586 | B2 * | 3/2005 | Ishikura | 347/43 |
| 7,300,137 | B2 | 11/2007 | Yamanaka et al. | |
| 7,465,008 | B2 | 12/2008 | Nunokawa et al. | |
| 7,604,310 | B2 * | 10/2009 | Sugimoto | 347/7 |
| 7,758,156 | B2 | 7/2010 | Takuhara et al. | |
| 8,303,063 | B2 * | 11/2012 | Kubota et al. | 347/9 |
| 8,313,158 | B2 * | 11/2012 | Kubota et al. | 347/9 |
| 2001/0017638 | A1 * | 8/2001 | Otsuki | 347/41 |
| 2003/0081029 | A1 | 5/2003 | Underwood | |
| 2003/0081061 | A1 * | 5/2003 | Gunther et al. | 347/43 |
| 2004/0022570 | A1 * | 2/2004 | Ioka et al. | 400/76 |
| 2004/0080555 | A1 * | 4/2004 | Otsuki et al. | 347/14 |
| 2004/0252160 | A1 * | 12/2004 | Iwasaki et al. | 347/41 |
| 2005/0088483 | A1 * | 4/2005 | Powers et al. | 347/43 |
| 2005/0200905 | A1 | 9/2005 | Kimura | |
| 2006/0181561 | A1 * | 8/2006 | Takahashi et al. | 347/14 |

FOREIGN PATENT DOCUMENTS

| | | | |
|---|---|---|---|
| JP | 03-045349 | A | 2/1991 |
| JP | 11-188896 | A | 7/1999 |
| JP | 2000-198227 | A | 7/2000 |
| JP | 2000-225719 | A | 8/2000 |
| JP | 2001-150793 | A | 6/2001 |
| JP | 2004-284064 | A | 10/2004 |
| JP | 2004-314534 | A | 11/2004 |
| JP | 2004-330624 | A | 11/2004 |
| JP | 2007-261205 | A | 10/2007 |
| JP | 2007-269021 | A | 10/2007 |
| JP | 2007261205 | A * | 10/2007 |
| JP | 2010-082822 | A | 4/2010 |

* cited by examiner

PSEUDO BAND PRINTING

| | PIGMENT INK | DYE INK |
|---|---|---|
| PAPER SEEPAGE | LOW (DOES NOT RUN READILY) | HIGH (RUNS READILY) |
| DOT DIAMETER | SMALL | LARGE |
| GLOSSINESS | LOW | HIGH |
| COLOR HUE | NEAR MAGENTA | NEAR CYAN |
| CONCENTRATION | HIGH | LOW |
| WATER RESISTANCE | HIGH | LOW |
| WEATHER RESISTANCE | HIGH | LOW |
| OTHER | GOOD FOR LETTER PRINTING | GOOD FOR PHOTOGRAPH PRINTING |

Fig. 7

BEFORE CORRECTION

AFTER CORRECTION

METHOD FOR MANUFACTURING PRINTING DEVICE, PRINTING DEVICE, AND PRINTING METHOD

CROSS-REFERENCE TO RELATED APPLICATIONS

This application claims priority to Japanese Patent Application No. 2010-114088 filed on May 18, 2010. The entire disclosure of Japanese Patent Application No. 2010-114088 is hereby incorporated herein by reference.

BACKGROUND

1. Technical Field

The present invention relates to a printing technique which uses pigment ink and dye ink.

2. Related Art

One known example of a printing device is an inkjet printing device which forms a printed image by discharging ink from nozzles onto a print medium to form ink dots (Japanese Laid-Open Patent Application Publication No. 11-188896, for example). Among inkjet printing devices, there are those which perform printing using two types of ink: pigment ink and dye ink. The term "pigment ink" refers to ink that uses a pigment as the ink coloring, and the term "dye ink" refers to ink that uses dye as the ink coloring. In comparison with dye ink, pigment ink commonly does not run readily on print paper and has low transparency, and pigment ink is therefore suitable for printing letters and other solid images. In comparison with pigment ink, dye ink runs readily on print paper and has high transparency, and dye ink is therefore suitable for printing photograph images.

When both pigment ink and dye ink are used to form a printed image, it is known that there are cases in which the colors expressed have different concentrations, depending on the order in which the ink dots of pigment ink and the ink dots of dye ink overlap. In a printing device which moves a print head back and forth to perform two-way printing, when the pigment ink nozzles and the dye ink nozzles are disposed in parallel in the movement direction of the print head, there is a switching of the order in which the pigment ink and the dye ink are discharged between the advancing and retreating of the print head. Therefore, with such a printing device, tone properties differ between printed images formed during the advancing of the print head and printed images formed during the retreating, and there is a possibility that the quality of the printed image will decrease.

SUMMARY

An object of the present invention is to provide a technique for suppressing the decrease in quality of printed images formed by printing that uses pigment ink and dye ink.

The present invention was devised in order to resolve at least some of the problems described above, and the present invention can be implemented as the following aspects.

A method according to a first aspect is a method for manufacturing a printing device which uses ink including pigment ink and dye ink to form a printed image on a print medium, and which discharges an ink quantity according to a voltage value of a drive voltage to form ink dots on the print medium. The method includes: forming a first image on the print medium by using the printing device to perform a first ink dot creation process for forming pigment ink dots and then forming dye ink dots adjacent to the pigment ink dots; forming a second image on the print medium by using the printing device to perform a second ink dot creation process for forming dye ink dots and then forming pigment ink dots adjacent to the dye ink dots; measuring the respective concentrations of the first image and the second image by concentration measurement means; and correcting the voltage value of the drive voltage for creating correction target ink dots so that the concentration difference between the first and second images is reduced, the correction target ink dots being selected in advance from between the pigment ink dots and the dye ink dots created in the forming of the first image or the forming of the second image.

When the printing device alternately aligns the pigment ink dots and dye ink dots to form a printed image, there are cases in which concentration differences arise in each area where the order of overlap between pigment ink dots and dye ink dots differs. However, according to this method, the correcting the printing concentration can made easier so that the occurrence of these concentration differences is suppressed. Specifically, it is possible to suppress the decrease in quality of the printed image formed by printing using pigment ink and dye ink.

A method according to a second aspect is the method according to the first aspect, wherein the correction target ink dots are preferably the pigment ink dots created in the forming of the first image.

According to this method, the concentration of an image area in which dye ink dots are formed overlapping pigment ink dots can be corrected by adjusting a printing voltage for creating the pigment ink dots.

A printing device according to a third aspect includes: nozzles configured and arranged to discharge ink to form ink dots on a print medium, the ink including pigment ink and dye ink, the nozzles including pigment ink nozzles for forming pigment ink dots and dye ink nozzles for forming dye ink dots; a nozzle control unit configured to control size of the ink dots by controlling a voltage value of a drive voltage and to control ink quantities discharged from the nozzles; and a storage unit configured to store a correspondence relationship between an adjustment value for adjusting the size of the ink dots and the voltage value of the drive voltage. The nozzle control unit is configured to perform a first printing process for forming pigment ink dot rows and dye ink dot rows adjacent to each other by causing the pigment ink nozzles to form pigment ink dots and then causing the dye ink nozzles to form dye ink dots adjacent to the pigment ink dots, and a second printing process for forming dye ink dot rows and pigment ink dot rows adjacent to each other by causing the dye ink nozzles to form dye ink dots and then causing the pigment ink nozzles to form pigment ink dots adjacent to the dye ink dots, so that a printed image including first and second printed image areas is formed respectively by the first and second printing processes. In the first and second printing processes, the nozzle control unit is configured to use the adjustment value and the correspondence relationship to vary the voltage value of the drive voltage for creating correction target ink dots selected in advance from between two types of ink dots including the pigment ink dots and the dye ink dots, so that concentration difference between the first and second printed image areas is reduced.

According to this printing device, the adjustment value for adjusting the size of the ink dots and the correspondence relationship between the adjustment value and the voltage value of the drive voltage applied to the nozzles can be used to adjust the side of the ink dots for printing so that the desired concentration is achieved. The concentration difference between the first and second printed image areas can thereby be reduced. It is therefore possible to suppress the decrease in the quality of the printed image formed by printing using pigment ink and dye ink.

A printing device according to a fourth aspect is the printing device according to the third aspect, wherein the correction target ink dots are preferably the pigment ink dots created in the first printing process.

According to this printing device, even when there is a possibility of concentration discrepancies occurring between the first printed area and the second printed area due to a different sequence of overlap between the pigment ink dots and the dye ink dots, the size of the pigment ink dots can be varied and the concentration in the first printed area can be adjusted.

A printing device according to a fifth aspect is the printing device according to the third or fourth aspect, preferably further including a print head which has pigment ink nozzle rows and dye ink nozzle rows parallel to each other in which the pigment ink nozzles and the dye ink nozzles are aligned in a aligned direction at a prescribed nozzle pitch, and which moves back and forth in first and second directions that intersect the alignment direction of the pigment ink nozzle rows and the dye ink nozzle rows. The pigment ink nozzle rows and the dye ink nozzle rows are preferably disposed in the print head such that the pigment ink nozzle rows are nearer the first direction and the dye ink nozzle rows are nearer the second direction, the pigment ink nozzles and the dye ink nozzles being offset from each other in the alignment direction. The first printing process preferably includes a process for printing the first printed image area while moving the print head in the first direction. The second printing process preferably includes a process for printing the second printed image area while moving the print head in the second direction. The nozzle control unit is preferably configured to form the printed image on the print medium by alternately performing the first and second printing processes.

According to this printing device, two-way printing can be performed using pigment ink and dye ink, and during this two-way printing it is possible to suppress concentration discrepancies between a printed area formed during advancing printing and a printed area formed during retreating printing.

The present invention can be implemented in various aspects, e.g., a printing method, a method for correcting printing concentration in a printing device and a printing device or printing system which performs the correction method, a computer program for implementing the functions of these methods, devices, or systems; a storage medium on which this computer program is stored, and the like.

BRIEF DESCRIPTION OF THE DRAWINGS

Referring now to the attached drawings which form a part of this original disclosure:

FIG. 7 is an explanatory chart showing a compilation of the characteristics of black pigment ink and dye ink;

DETAILED DESCRIPTION OF EXEMPLARY EMBODIMENTS

A. First Embodiment

Figure 1:
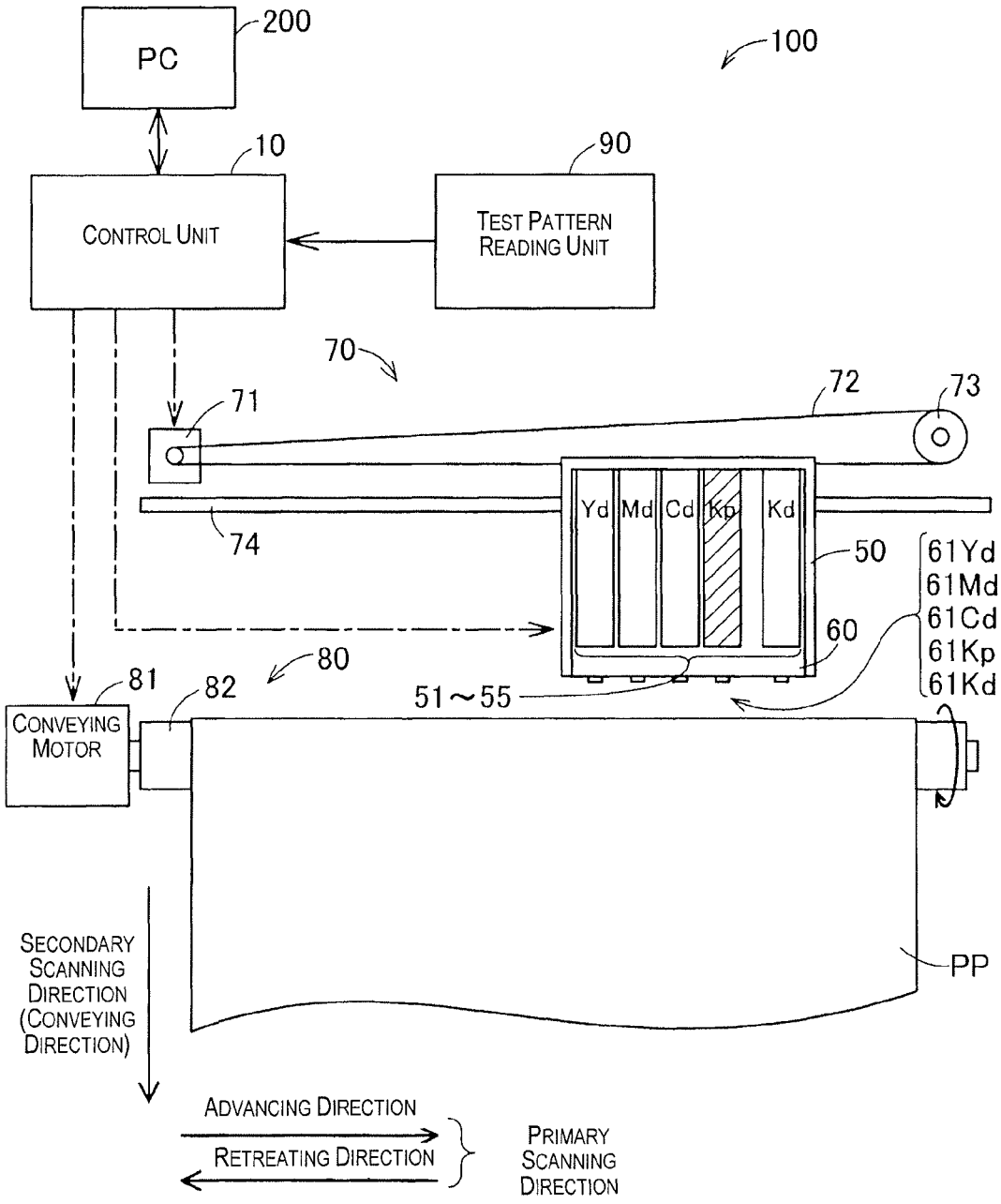
FIG. 1 is a schematic diagram showing the configuration of a printing device.

FIG. 1 is a schematic diagram showing the configuration of a printing device 100 as an embodiment of the present invention. This printing device 100 is an inkjet printer which discharges ink droplets onto paper PP as a print medium and forms printed images by the created ink dots, and the printing device 100 performs a printing process by two-way printing. The printing device 100 comprises a control unit 10, a carriage 50, a print head 60, a carriage drive unit 70, paper conveying unit 80, and a test pattern reading unit 90.

Figure 2:
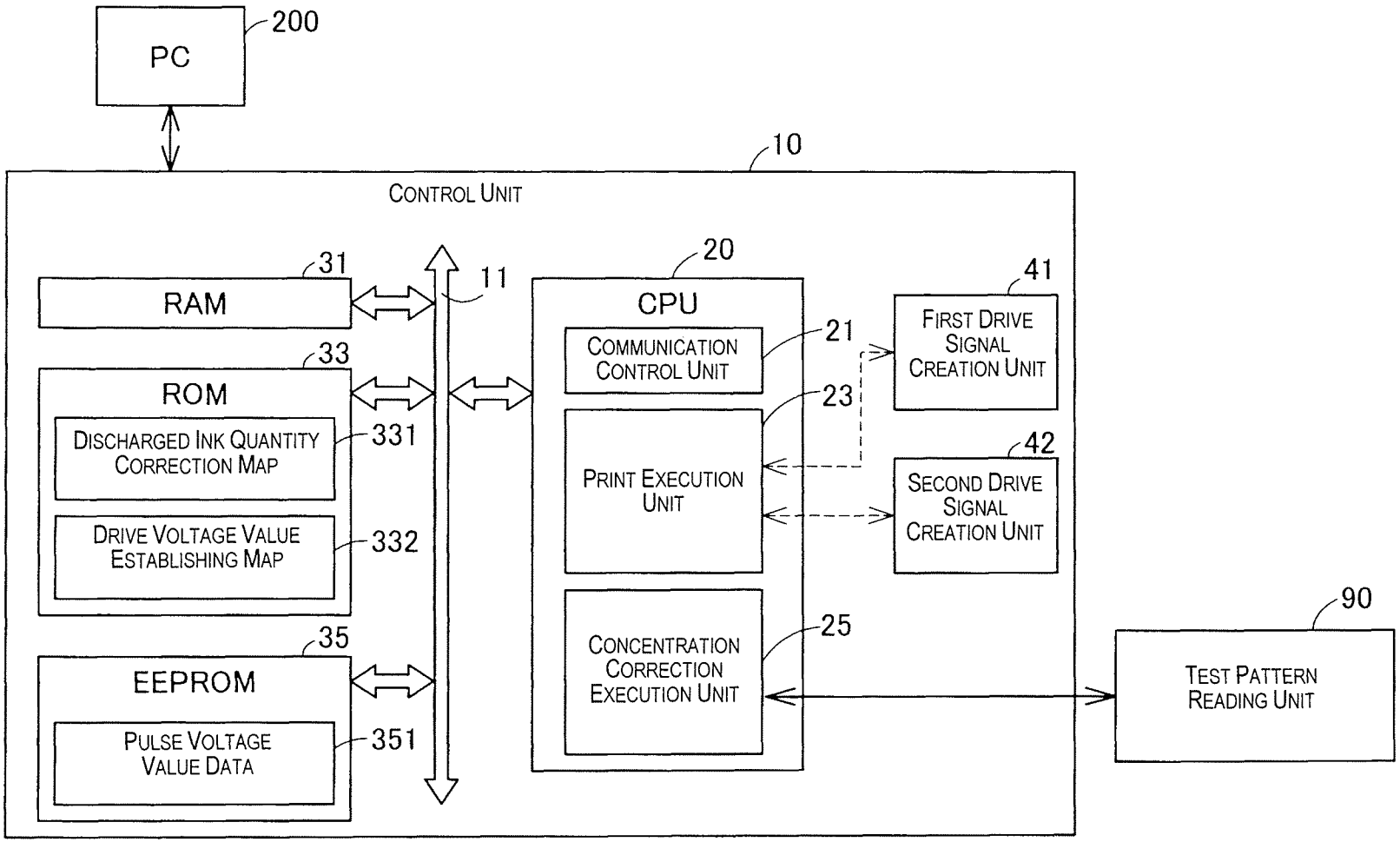
FIG. 2 is a schematic block diagram showing the internal configuration of a control unit.

FIG. 2 is a schematic block diagram showing the internal configuration of the control unit 10. FIG. 2 shows a personal computer 200 and the test pattern reading unit 90 which are connected to the control unit 10. The control unit 10 is connected with the external personal computer (PC) 200 via a USB (Universal Serial Bus) or another interface. The control unit 10 is connected with the test pattern reading unit 90 via a signal wire.

The control unit 10 comprises a CPU 20, a RAM 31, a ROM 33, an EEPROM 35, and first and second drive signal creation units 41, 42. The CPU 20, the RAM 31, the ROM 33, and the EEPROM 35 are connected to each other by an internal bus 11. The CPU 20 functions as a communication control unit 21, a print execution unit 23, and a concentration correction execution unit 25 by reading programs stored in advance in the ROM 33 and the EEPROM 35, and opening and running the programs in the RAM 31.

The communication control unit 21 controls communication with the personal computer 200 and other external devices. The print execution unit 23 controls the structural components of the printing device 100 and executes the printing process (described hereinafter) on the basis of print data received from the personal computer 200. The concentration correction execution unit 25 executes a process for correcting the printing concentration of the printing device 100.

A discharged ink quantity correction map 331 and a drive voltage value establishing map 332 are stored in advance in the ROM 33, and pulse voltage value data 351 is stored in the EEPROM 35. The test pattern reading unit 90, which has an optical sensor, performs a measurement of the image concentration of a test pattern for a correction process (described hereinafter) by a directive from the concentration correction execution unit 25.

During the process of correcting the printing concentration, the concentration correction execution unit 25 uses concentration measurement values acquired from the discharged ink quantity correction map 331, the drive voltage value establishing map 332, the pulse voltage value data 351, and the test pattern reading unit 90. The specific details of the printing concentration correction process will be described hereinafter.

The first and second drive signal creation units 41, 42 each create a drive signal for driving the nozzles by a directive from the print execution unit 23. The drive signals are applied to the nozzles by the print execution unit 23 when the printing process is executed. The details of the specific drive signals are described hereinafter.

Five ink cartridges 51 to 55 are mounted in the carriage 50 (FIG. 1). The first through third ink cartridges 51 to 53 respectively contain yellow dye ink (Yd), magenta dye ink (Md), and cyan dye ink (Cd). The fourth ink cartridge 54 contains black pigment ink (Kp), and the fifth ink cartridge 55 contains black dye ink (Kd). Specifically, with this printing device 100, color printing is possible with dye ink printing, and monochrome printing is possible with both dye ink printing and pigment ink printing.

The print head 60 is disposed in the bottom part of the carriage 50. In the bottom surface of the print head 60 (the surface that faces the paper PP), first through fifth nozzles 61Yd, 61Md, 61Cd, 61Kp, and 61Kd are provided for discharging the colored dye inks and the black pigment ink.

The aforementioned ink cartridges 51 to 55 are installed above the nozzles 61Yd, 61Md, 61Cd, 61Kp, and 61Kd of the corresponding colors, and the ink cartridges supply ink to the nozzles 61Yd, 61Md, 61Cd, 61Kp, and 61Kd. The arranged configuration of the nozzles 61Yd, 61Md, 61Cd, 61Kp, and 61Kd in the bottom surface of the print head 60 will be described hereinafter.

The carriage drive unit 70 is a drive mechanism for moving the carriage 50 back and forth in a linear direction (the left-right direction of the image plane in FIG. 1) along the surface of the paper PP. The carriage drive unit 70 comprises a carriage motor 71, a drive belt 72, a pulley 73, and a sliding shaft 74. The sliding shaft 74 extends in the movement direction of the carriage 50 and holds the carriage 50 in a slidable manner. The drive belt 72 is an endless belt harnessed between the carriage motor 71 and the pulley 73, and the carriage 50 is attached to the drive belt 72 in a stationary manner.

The carriage motor 71 is rotatably driven by a directive from the print execution unit 23. The carriage 50 and the print head 60 are moved back and forth along the print surface of the paper PP by the rotation of the drive belt 72 which accompanies the rotational driving of the carriage motor 71. In this Specification, the back-and-forth movement direction of the carriage 50 and the print head 60 is referred to as the "primary scanning direction," and the image-plane-right direction and image-plane-left direction in particular in FIG. 1 are referred to respectively as the "advancing direction" and the "retreating direction."

The paper conveying unit 80 comprises a conveying motor 81 and a platen 82. The platen 82 is a rotating shaft extending in a direction parallel with the primary scanning direction, and is rotated by the conveying motor 81. The conveying motor 81 is driven according to a directive from the print execution unit 23. During the printing process, the paper PP is placed on the side surface of the platen 82 and is conveyed by the rotation of the platen 82. In this Specification, the direction in which the paper PP is conveyed during the printing process is referred to simply as the "conveying direction" or the "secondary scanning direction."

When the print execution unit 23 receives print data from the personal computer 200, a printing process is performed with two-way printing. Specifically, the print execution unit 23 moves the print head 60 a fixed distance in the advancing direction or the retreating direction and causes ink to be discharged from the nozzles 61Yd, 61Md, 61Cd, 61Kp, and 61Kd of each color in accordance with the print data. The print execution unit 23 executes the discharge of ink by applying the drive signals created by the first and second drive signal creation units 41, 42 to the nozzles in accordance with the print data.

Figure 3A:
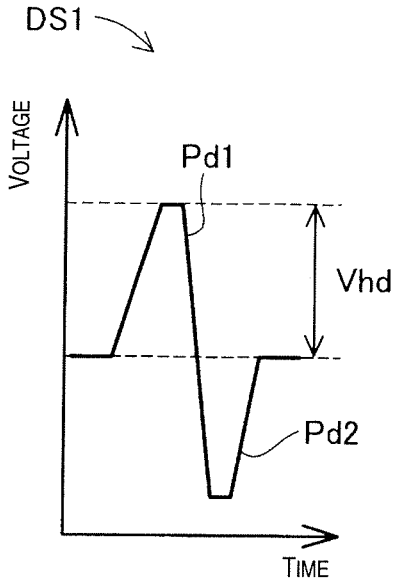
FIGS. 3A to 3C are schematic diagrams for describing drive signals for creating ink dots.
Figure 3B:
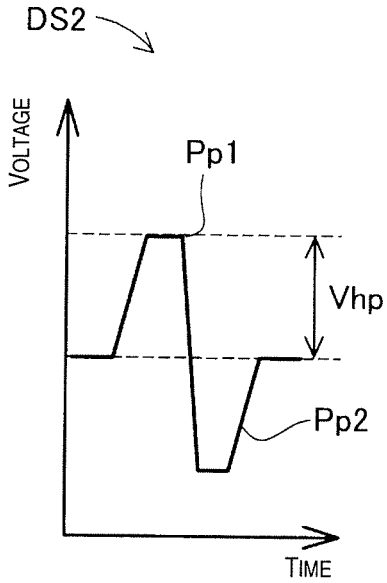

FIGS. 3A and 3B are schematic diagrams for describing the drive signals for creating ink dots in the printing device 100 of the present embodiment. FIGS. 3A and 3B show examples of first and second drive signals DS1, DS2, respectively, wherein the vertical axes represent voltage and the horizontal axes represent time. The first and second drive signals DS1, DS2 are continuous with each other, and have upward convex pulses Pd1, Pp1 and downward convex pulses Pd2, Pp2.

The first drive signal DS1 is created by a first drive signal creation unit 41 and supplied to nozzles 61Yd, 61Md, 61Cd, 61Kd for dye ink. The second drive signal DS2 is created by a second drive signal creation unit 42 and supplied to a nozzle 61Kp for black pigment ink. The signal pulse widths or amplitudes of the first drive signal DS1 and the second drive signal DS2 are varied according to the respective ink characteristics of the pigment ink and dye ink.

The nozzles 61Yd, 61Md, 61Cd, 61Kp, 61Kd (FIG. 1) are communicated with ink chambers (not shown) filled with ink, and piezo elements (not shown) functioning as pressure-generating elements are disposed on the walls of the ink chambers. The piezo elements deform according to the variation in the electric potential of the applied drive pulse and vary the pressure in the ink chambers. Ink droplets are thereby discharged from the nozzles 61Yd, 61Md, 61Cd, 61Kp, 61Kd by the variation in pressure inside the ink chambers.

The ink quantities discharged from the nozzles 61Yd, 61Md, 61Cd, 61Kp, 61Kd can be adjusted by varying the maximum values of the upward convex pulses Pd1, Pp1 (hereinafter referred to as the "drive voltage values Vhd, Vhp"). In the printing device 100 of the present embodiment, the drive voltage values Vhd, Vhp are stored as pulse voltage value data 351 in the EEPROM 35, where they can be updated.

Figure 3C:
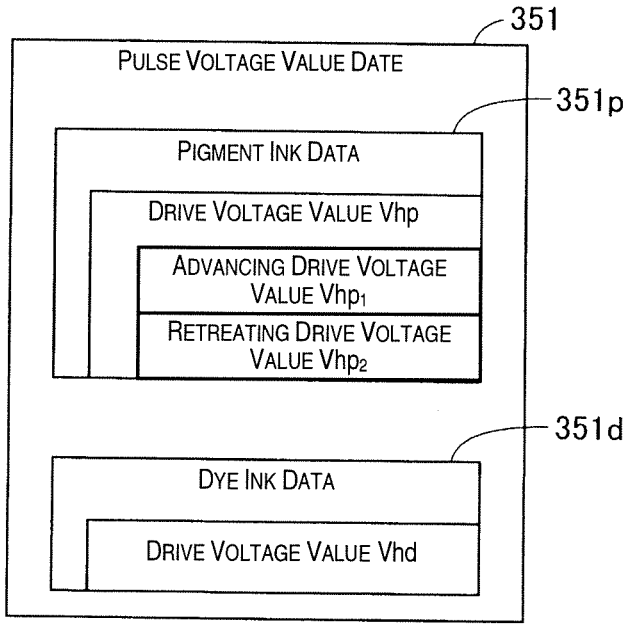

FIG. 3C is a block diagram showing the configuration of the pulse voltage value data 351. The pulse voltage value data 351 is drive signal creation data expressing a variation pattern of the electric potential used when the first and second drive signal creation units 41, 42 create the first and second drive signals DS1, DS2. The pulse voltage value data 351 has dye ink data 351*d* and pigment ink data 351*p*.

The dye ink data 351*d* includes a drive voltage value Vhd for dye ink. The pigment ink data 351*p* includes an advancing drive voltage value $Vhp_1$ and a retreating drive voltage value $Vhp_2$ as a drive voltage value Vhp for pigment ink. The reason for setting two values as the drive voltage value Vhp for pigment ink in this manner will be described hereinafter. The pulse voltage value data 351 is read from the ROM 33 or EEPROM 35 and transmitted to the first and second drive signal creation units 41, 42 by the print execution unit 23.

After ink dot rows have finished being formed in alignment along the primary scanning direction on the paper PP by the scanning of the print head 60 in the advancing direction or the retreating direction, the print execution unit 23 moves the paper PP by a predetermined conveying distance in the conveying direction. The print execution unit 23 then causes the print head 60 to begin scanning in the opposite direction of the aforementioned scanning direction and performs ink discharge according to the print data. Ink dot rows are thereby formed on the paper PP in parallel with the ink dot rows that were formed first. The printing device 100 forms a printed image by alternately repeating the formation of ink dot rows by scanning the print head 60 in the primary scanning direction, and the conveying of the paper PP.

Figure 4:
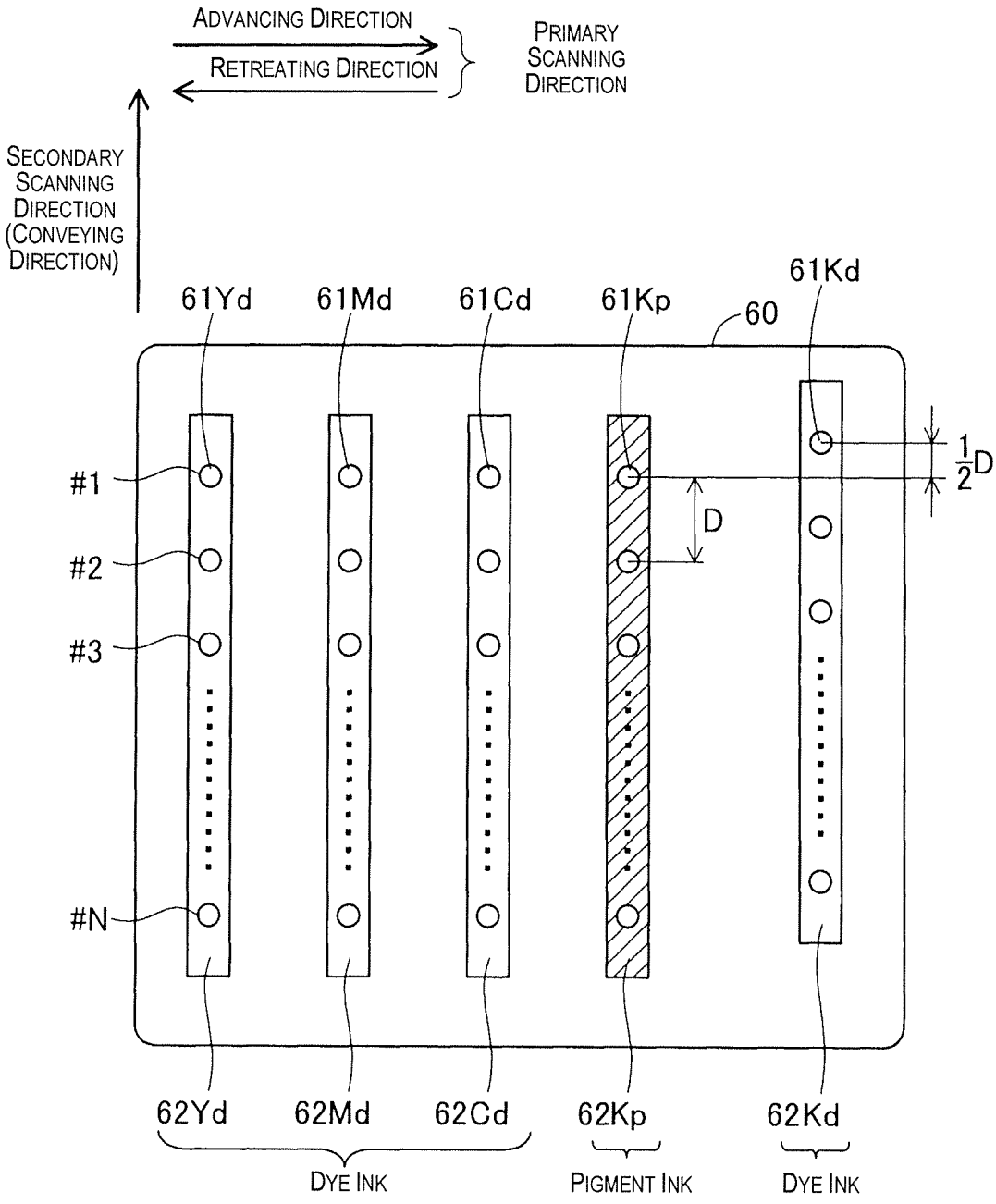
FIG. 4 is a schematic drawing for describing the arrangement configuration of nozzles provided to a print head.

FIG. 4 is a schematic drawing for describing the arrangement configuration of the nozzles provided to the print head 60. FIG. 4 shows a schematic depiction of the bottom surface (the surface that faces the paper PP) of the print head 60. The nozzles 61Yd, 61Md, 61Cd, 61Kp, 61Kd are aligned in rows of N nozzles (N being an arbitrary natural number) aligned along the secondary scanning direction, constituting first through fifth nozzle rows 62Yd, 62Md, 62Cd, 62Kp, 62Kd. Specifically, the first through third nozzle rows 62Yd, 62Md, 62Cd are configured from nozzles 61Yd, 61Md, 61Cd for yellow, magenta, and cyan dye ink. The fourth and fifth nozzle rows 62Kp, 62Kd are configured from nozzles 61Kp, 61Kd for black pigment ink and black dye ink.

The nozzles 61Yd, 61Md, 61Cd, 61Kp, 61Kd are aligned at substantially constant intervals D (hereinafter referred to as the "nozzle pitch D") within the nozzle rows 62Yd, 62Md, 62Cd, 62Kp, 62Kd. The nozzles 61Yd, 61Md, 61Cd, 61Kp of the first through fourth nozzle rows 62Yd, 62Md, 62Cd, 62Kp are also provided so that the nozzles of each color are arranged in straight lines along the primary scanning direction.

The nozzles 61Kd of the fifth nozzle row 62Kd are provided so as to be offset from the nozzles 61Kp of the fourth nozzle row 62Kp by a distance (½D) half of the nozzle pitch D. Such an arrangement configuration of the nozzles 61Yd, 61Md, 61Cd, 61Kp, 61Kd allows the printing device 100 of the present embodiment to suitably perform two printing processes: pseudo band printing using dye ink, and band printing using pigment ink and dye ink.

Figure 5A:
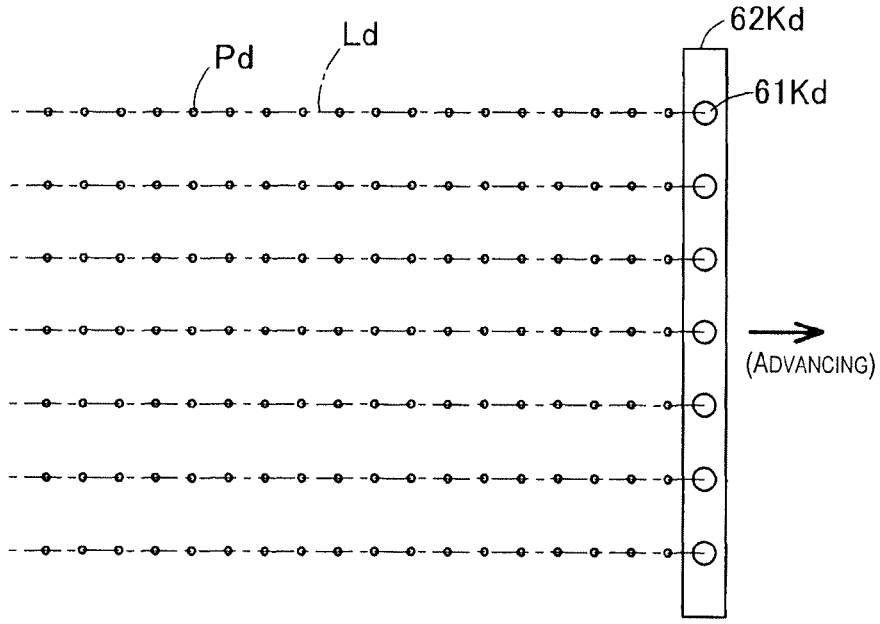
FIGS. 5A and 5B are schematic diagrams showing the sequence of the steps of pseudo band printing using dye ink.
Figure 5B:
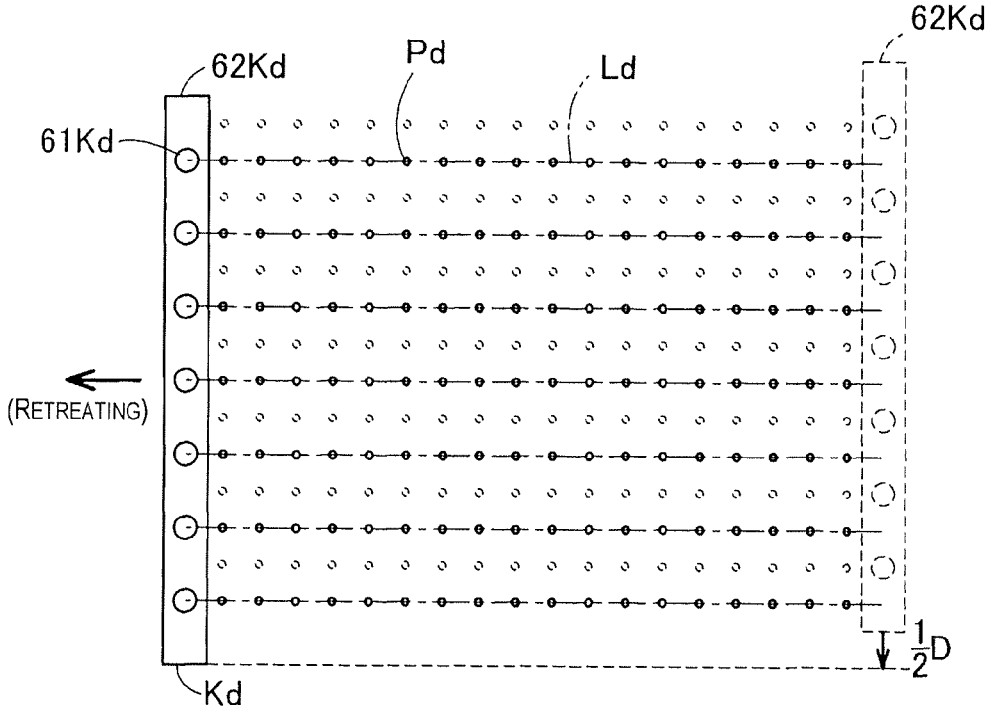

FIGS. 5A and 5B are schematic diagrams showing the sequence of the process of pseudo band printing using dye ink. FIGS. 5A and 5B both show the fifth nozzle row 62Kd for black dye ink in the print head 60. For the sake of convenience, FIGS. 5A and 5B show seven (N=7) nozzles 61Kd of the fifth nozzle row 62Kd. In FIGS. 5A and 5B, the movement trajectories Ld of the nozzles 61Kd in pseudo band printing are shown as single-dash lines, and the discharge positions Pd of the black dye ink are shown as white circles on these lines.

Furthermore, for the sake of convenience, FIG. 5B uses dashed lines to show the position of the fifth nozzle row 62Kd immediately after the process of FIG. 5A has finished, as well as the ink discharge positions Pd in the process of FIG. 5A. When a color image is printed, pseudo band printing by the other dye ink nozzle rows 62Yd, 62Md, 62Cd is also performed in parallel, but the specifics thereof are similar to those of the fifth nozzle row 62Kd and are therefore not illustrated or described.

In pseudo band printing, the print execution unit 23 moves the fifth nozzle row 62Kd (the print head 60) in the advancing direction and causes ink to be discharged at intervals according to the pixel pitch of the printed image (FIG. 5A). Ink dots rows parallel to each other in the secondary scanning direction and separated by a nozzle pitch D are thereby formed on the paper PP in a number corresponding to the number of nozzles 61Kd.

Next, the print execution unit 23 moves the paper PP in the conveying direction by a distance of half the nozzle pitch D (½D). The print execution unit 23 then moves the print head 60 in the retreating direction and causes ink to be discharged at intervals according to the pixel pitch of the printed image (FIG. 5B). New ink dot rows are thereby formed adjacent to the parallel ink dot rows formed in the process of FIG. 5A).

After the process of forming ink dot rows in FIG. 5B, the print execution unit 23 moves the paper PP equivalent to one band (specifically, a distance equal to the number of nozzles N×the nozzle pitch D) and again performs the same process of forming ink dots rows in the advancing direction as in FIG. 5A. Specifically, with this pseudo band printing, an equivalent of one band of the printed image is formed by a single back-and-forth scan of the print head 60, and the printed image is formed by repeating this single band equivalent printing.

Figure 6B:
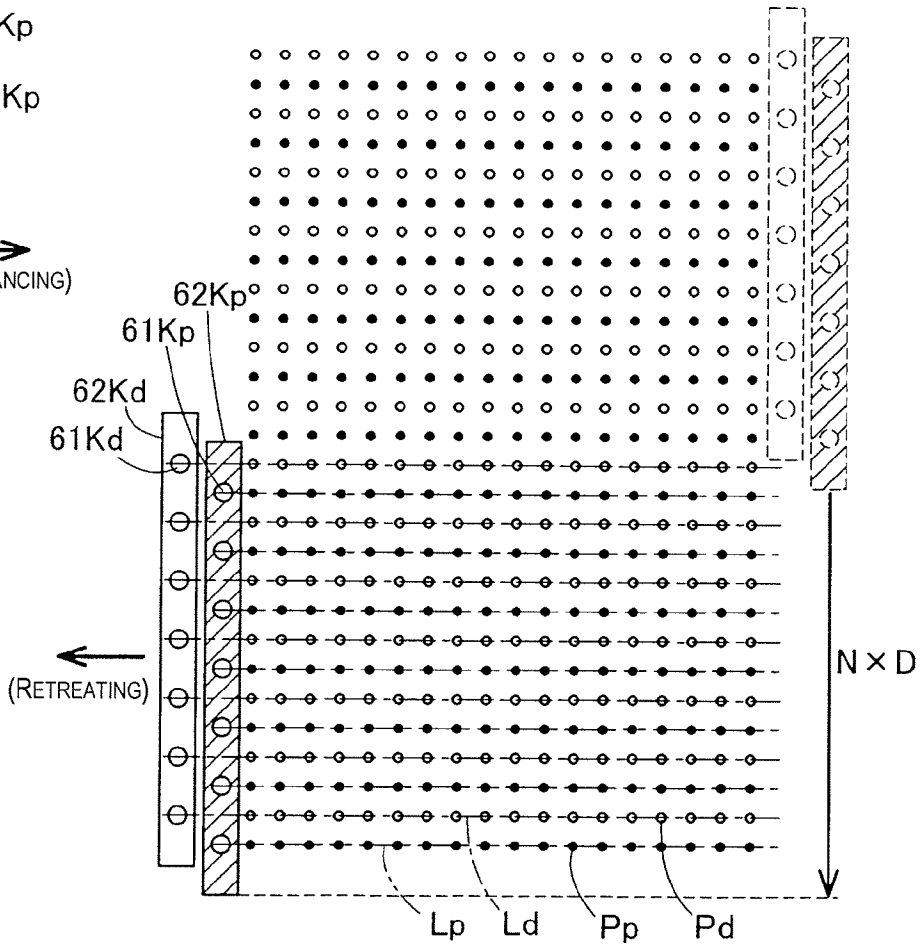
FIGS. 6A and 6B are schematic diagrams showing the sequence of the process of band printing which is performed using black pigment ink and dye ink.
Figure 6A:
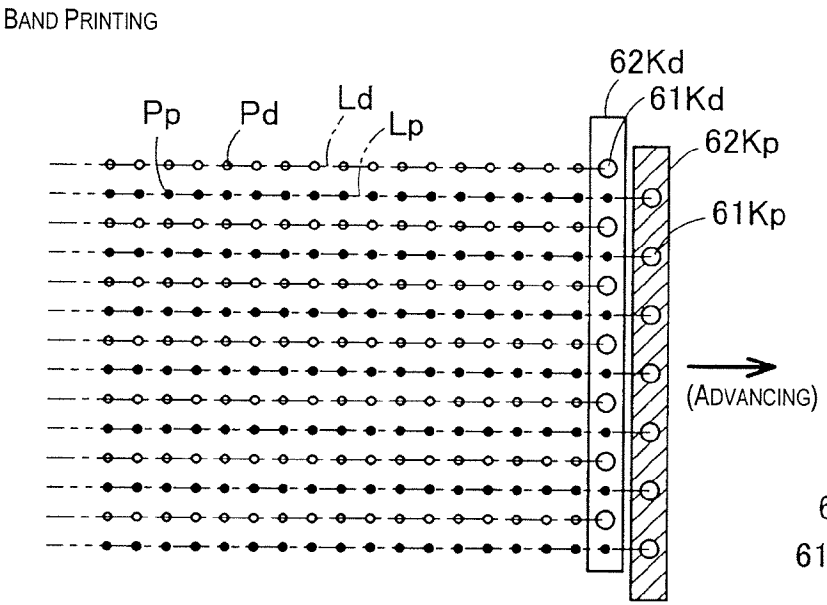

FIGS. 6A and 6B are schematic diagrams similar to FIGS. 5A and 5B, showing the sequence of the process of band printing which is performed using black dye ink and pigment ink. FIGS. 6A and 6B show the fourth and fifth nozzle rows 62Kp, 62Kd in the print head 60. FIGS. 6A and 6B show single-dash lines and double-dash lines indicating the respective movement trajectories Lp, Ld of the nozzles 61Kp, 61Kd in band printing, as well as black circles and white circles indicating the discharge positions Pp, Pd of the black pigment ink and dye ink. For the sake of convenience, FIG. 6B shows the ink discharge positions Pp, Pd in the process of FIG. 6A, and the arranged positions of the fourth and fifth nozzle rows 62Kp, 62Kd immediately after completion of the process of FIG. 6A are shown in dashed lines.

In band printing, the print execution unit 23 moves the fourth and fifth nozzle rows 62Kp, 62Kd (the print head 60) in the advancing direction and causes black pigment ink and dye ink to be discharged at intervals according to the pixel pitch of the printed image (FIG. 6A). Ink dot rows (dye ink dot rows and pigment ink dot rows aligned alternately in the secondary scanning direction) parallel to each other and separated by a distance equal to half the nozzle pitch D (½D) are thereby formed on the paper PP in a number corresponding to the number N of the nozzles 61Kp, 61Kd.

Next, the print execution unit 23 moves the paper PP by a distance (N×D) equivalent to one band in the conveying direction. While then moving the print head 60 back the other way in the retreating direction, the print execution unit 23 discharges black pigment ink and dye ink at intervals according to the pixel pitch of the printed image (FIG. 6B). A group of new ink dot rows is thereby formed downstream in the conveying direction from the plurality of groups of parallel ink dot rows formed in the process described in FIG. 6A.

Specifically, in band printing, an equivalent of two bands of the printed image is formed by a single back-and-forth scan of the print head 60, and a printed image is formed by repeating this two-band printing. Thus, when a monochrome printed image is printed with the printing device 100 of the present embodiment, performing this band printing makes it possible to print at a faster speed than printing by pseudo band printing.

In this Specification, within the printed image formed by band printing, the area of the printed image that is formed when the print head 60 moves in the advancing direction is referred to as the "advancing printed area." The area of the printed image that is formed when the print head 60 moves in the retreating direction is referred to as the "retreating printed area."

Even if the pigment ink and the dye ink are the same black, they differ in terms of their color hues and the readiness of their ink components to seep into the paper PP (referred to as "paper seepage" in this Specification). The differences in characteristics between the pigment ink and dye ink used in the printing device 100 of the present embodiment are described hereinbelow.

FIG. 7 is an explanatory chart showing a compilation of the characteristics of the black pigment ink and dye ink used in the printing device 100 of the present embodiment. To compare the pigment ink and dye ink of the present embodiment, the paper seepage is lower with pigment ink and higher with dye ink. Specifically, the ink droplets of the pigment ink do not run readily into the print paper, while the ink droplets of the dye ink do run readily into the print paper. This is because with pigment ink, the pigment components are readily retained on the surface of the print paper.

Because of such a difference in the paper seepage, when ink of the same amount is discharged from both the nozzles 61Kp and 61Kd of the print head 60, the size of the ink dots formed on the paper PP tends to be smaller in the pigment ink than in the dye ink. Unevenness in the surfaces of the ink dots of pigment ink is formed by the pigment components remaining on the surface of the paper PP. Therefore, the printed image formed by the ink dots of pigment ink has less glossiness than the printed image formed by dye ink.

Furthermore, as for color hue, the black pigment ink has a color hue near that of magenta, and the black dye ink has a color hue near that of cyan. Therefore, when the printed image formed by pigment ink and the printed image formed by dye ink have the same ink quantity included per unit surface area, the printed image of pigment ink has a higher concentration than the printed image of dye ink.

As another example of a difference in ink characteristics, the pigment ink has higher water resistance and weather resistance than the dye ink. Pigment ink is commonly suitable for printing letters because of its lack of running and higher concentration of coloring, while dye ink is commonly suitable for printing photograph images because of its readiness to run and transparency.

In a printed image formed by band printing, a pigment ink dot Dp and a dye ink dot Dd are aligned alternately in a row along the conveying direction (FIGS. 6A and 6B). The pigment ink dot Dp and the dye ink dot Dd, which are adjacent to each other, also overlap each other depending on their dot sizes. Because of their differences in characteristics, the pigment ink dot Dp and the dye ink dot Dd have different color hues and concentrations depending on the order in which they overlap each other.

Figure 8A:
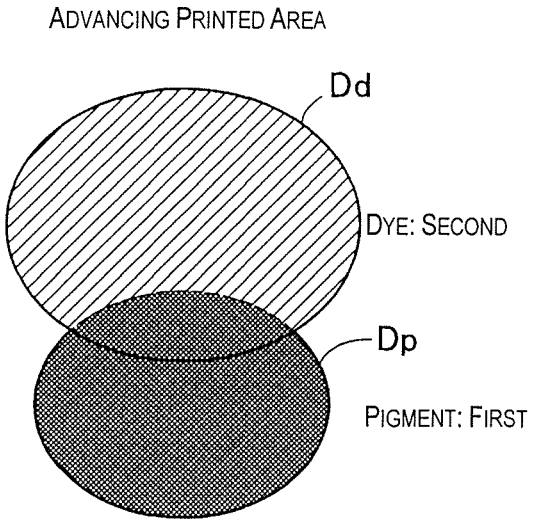
FIGS. 8A to 8C are schematic drawings for describing the overlapping between pigment ink dots and dye ink dots in band printing.
Figure 8B:
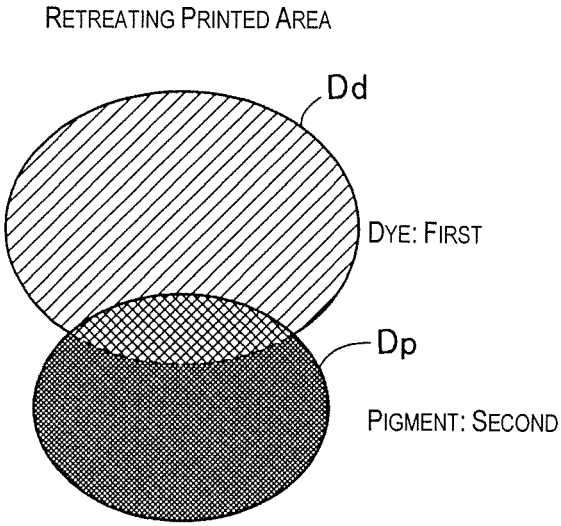
Figure 8C:
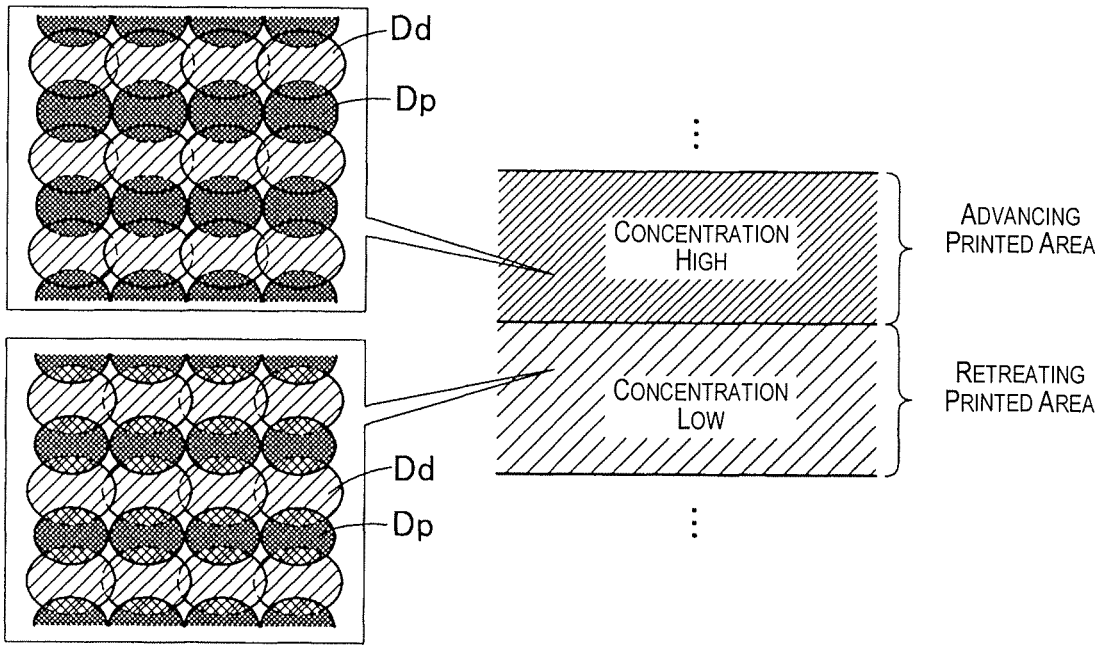

FIGS. 8A to 8C are schematic drawings for describing the overlapping between pigment ink dots and dye ink dots in band printing. FIGS. 8A through 8C schematically depict the difference in concentration between the ink and the printed images by the difference in hatching concentration. FIGS. 8A and 8B schematically depict the overlapping between an adjacent pigment ink dot Dp and dye ink dot Dd formed in band printing. FIG. 8A shows a pigment ink dot Dp and a dye ink dot Dd formed in an advancing printed area, and FIG. 8B shows a pigment ink dot Dp and a dye ink dot Dd formed in a retreating printed area.

When printing is performed in the advancing direction during band printing, the print head 60 moves such that the fourth nozzle row 62Kp for black pigment ink is forward and the fifth nozzle row 62Kd for black dye ink is rearward (FIG. 6A). Therefore, during printing in the advancing printed area, the adjacent dye ink dot Dd is formed after the pigment ink dot Dp (FIG. 8A).

When printing is performed in the retreating direction during band printing, the print head 60 moves such that the fifth nozzle row 62Kd for black dye ink is forward and the fourth nozzle row 62Kp for black pigment ink is rearward (FIG. 6B). Therefore, during printing in the retreating printed area, the adjacent pigment ink dot Dp is formed after the dye ink dot Dd (FIG. 8B).

When dye ink is discharged over the pigment ink dot Dp formed on the paper PP (FIG. 8A), the pigment components of the pigment ink having a dark color hue cover the external surface of the paper PP, and the pigment ink is then overlapped by the dye ink having a light color hue and high transparency. In this case, the concentration of the area where the ink dots Dp, Dd overlap each other is substantially the same as the concentration of the pigment ink dot.

When pigment ink is discharged on top of a dye ink dot Dd (FIG. 8B), the pigment components of the pigment ink seep or diffuse into the components of the dye ink that have seeped into the paper PP. Therefore, the concentration in the area where the ink dots Dp, Dd overlap each other is less than in FIG. 8A.

FIG. 8C is a schematic diagram showing an image formed by the band printing of the printing device 100 of the present embodiment, wherein ink dots Dp, Dd are distributed uniformly. In FIG. 8C, the right side shows part of a printed image including an advancing printed area and a retreating printed area, while the left side shows an enlarged schematic view of an arrangement of ink dots Dp, Dd constituting the advancing printed area and the retreating printed area. FIG. 8C shows a state of the advancing printed area and the retreating printed area in which the concentrations of both pigment ink dots and dye ink dots are higher in the advancing printed area than in the retreating printed area, regardless of dots of the same size being aligned uniformly.

As described above, depending on the order of overlap between the pigment ink dots Dp and the dye ink dots Dd, the concentration differs in the in the area of overlap. Therefore, when a printed image has been formed by band printing, there is a possibility that there will be a difference in concentration per unit surface area between the advancing printed area and the retreating printed area, depending on the extent of overlap between the adjacent pigment ink dots Dp and dye ink dots Dd. In view of this, in the printing device 100 of the present embodiment, the extent of overlap between the pigment ink dots Dp and the dye ink dots Dd is adjusted and the concentration difference between the advancing printed area and the retreating printed area is corrected by adjusting the size of the pigment ink dots Dp in the advancing printed area.

Figure 9:
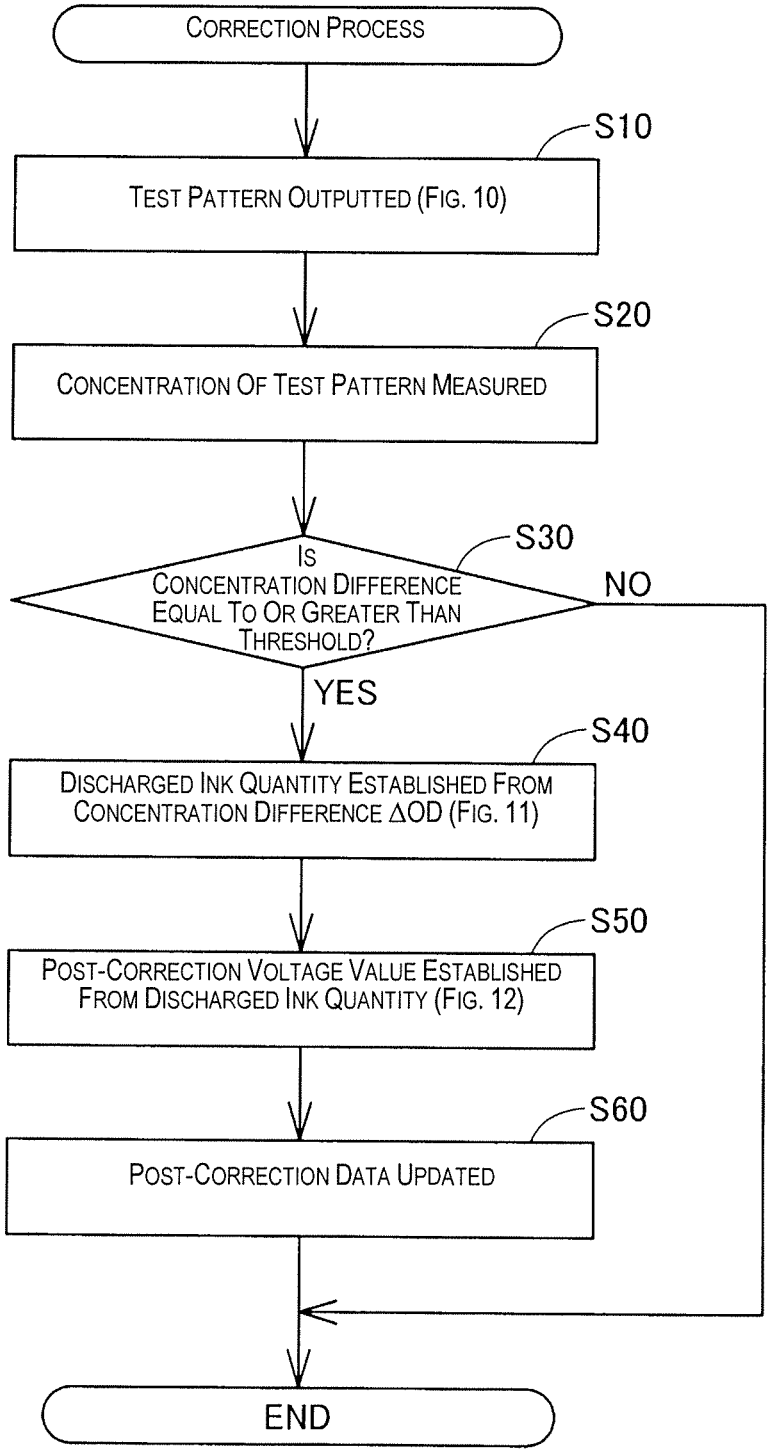
FIG. 9 is a flowchart showing the sequence of a print concentration correction process executed by a concentration correction execution unit.

FIG. 9 is a flowchart showing the sequence of the print concentration correction process executed by the concentration correction execution unit 25. This correction process is executed in the printing device 100 by a command from the user via the personal computer 200 or an operation unit (not shown) of the printing device 100. In step S10, the concentration correction execution unit 25 reads test pattern print data (not shown) stored in advance in the ROM 33 and transmits the data to the print execution unit 23. The print execution unit 23 prints the test pattern on the paper PP on the basis of this print data.

Figure 10:
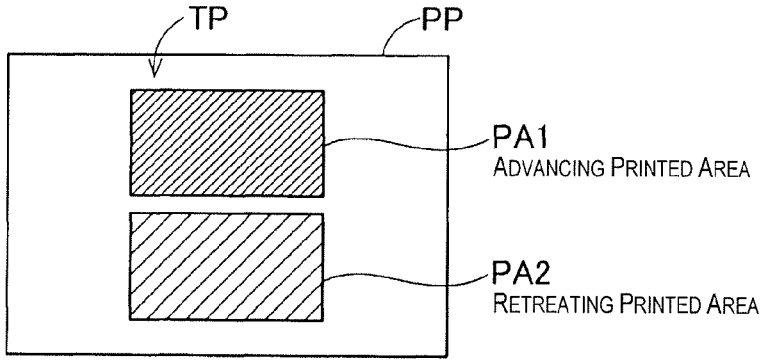
FIG. 10 is a schematic drawing showing an example of a test pattern printed on a paper.

FIG. 10 is a schematic drawing showing an example of a test pattern TP printed on the paper PP in step S10. The test pattern TP has an advancing test image PA1 and a retreating test image PA2. The advancing test image PA1 and the retreating test image PA2 are print images formed by moving the print head 60 in the advancing direction or the retreating direction and discharging black pigment ink and dye ink.

Specifically, the advancing test image PA1 is an image of uniform concentration configured only by the advancing printed area in the band printing previously described, and the retreating test image PA2 is an image of uniform concentration configured only by the retreating printed area in the band printing. Between the advancing test image PA1 and the retreating test image PA2, the alignment configuration of the ink dots is the same, and the only difference is in the order of overlap between the pigment ink dots and the dye ink dots.

In step S20, the test pattern reading unit 90 measures the respective concentrations $OD_1$, $OD_2$ per unit surface area of the advancing test image PA1 and the retreating test image PA2 included in the test pattern TP. After outputting the test pattern TP, the printing device 100 may allow the user to issue a directive to the test pattern reading unit 90 to read the test pattern TP. The concentrations $OD_1$, $OD_2$ measured by the test pattern reading unit 90 are transmitted to the concentration correction execution unit 25 (FIG. 2).

In step S30, the concentration correction execution unit 25 makes a determination of whether or not to execute correction of the printing concentration. Specifically, the concentration correction execution unit 25 uses the measured values $OD_1$, $OD_2$ acquired from the test pattern reading unit 90 to calculate the concentration difference ΔOD between the advancing test image PA1 and the retreating test image PA2 ($\Delta OD=OD_1-OD_2$).

When the concentration difference ΔOD is equal to or greater than a predetermined threshold, a size adjustment process is performed on the ink dots from step S40 onward. When the concentration difference ΔOD is less than the predetermined threshold, the print concentration correction process is ended. In this case, the concentration correction execution unit 25 may notify the user that the print concentration correction process is not being performed.

In steps S40 to S50, a process is executed for adjusting the size of the pigment ink dots constituting the advancing printed area. The size of the ink dots created on the paper PP varies according to the ink quantity discharged from the nozzles 61Yd, 61Md, 61Cd, 61Kp, 61Kd (the discharged ink quantity). As previously described, the discharged ink quantity can be adjusted by the drive voltage values Vhd, Vhp of the drive signals DS1, DS2 (FIGS. 3A and 3B). In view of this, the concentration correction execution unit 25 adjusts the maximum voltage value Vhp of the drive signal DS2 for pigment ink and corrects the print concentration of the printing device 100 in the process described hereinbelow.

Figure 11:
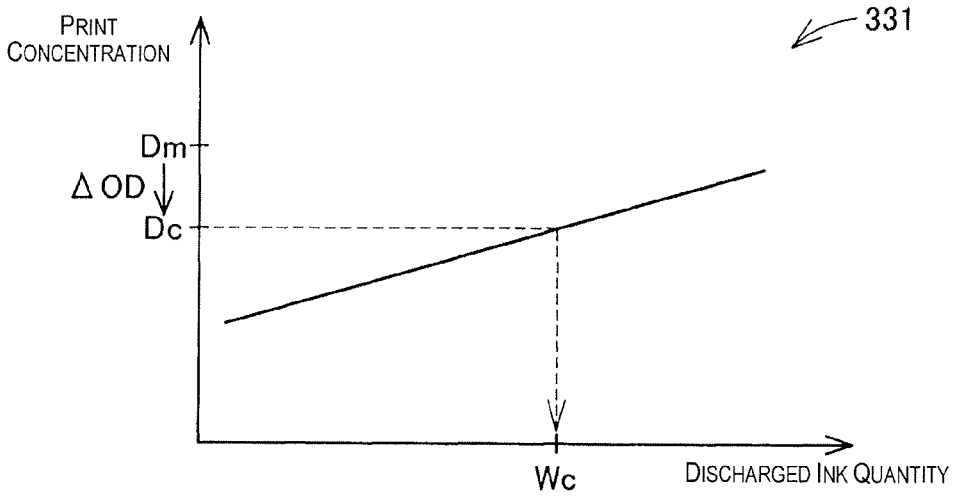
FIG. 11 is a schematic diagram for describing a process of adjusting discharged ink quantity.

FIG. 11 is a schematic diagram for describing the process of adjusting the discharged ink quantity in step S40. FIG. 11 shows an example of a discharged ink quantity correction map 331 (FIG. 2) used in step S40. In step S40, the concentration correction execution unit 25 reads the discharged ink quantity correction map 331 from the ROM 33.

The discharged ink quantity correction map 331 is a graph whose horizontal axis represents the discharged ink quantity and whose vertical axis represents the print concentration. Specifically, the discharged ink quantity correction map 331 shows the correspondence relationship between the discharged ink quantity for pigment ink dots created when a printed image similar to the advancing test image PA1 is formed, and the optical concentration per unit surface area of the printed image. The relationship shown by the discharged ink quantity correction map 331 is a relationship obtained in advance by testing or the like, and is also obtained for each characteristic of the pigment ink and the paper PP.

The concentration correction execution unit 25 subtracts the concentration difference ΔOD calculated in step S30 from the concentration $OD_1$ of the advancing test image PA1 acquired in step S20, and calculates the resulting value as a target print concentration ODc ($ODc=OD_1-\Delta OD$). The concentration correction execution unit 25 then uses the discharged ink quantity correction map 331 to acquire a target discharged ink quantity Wc which is a discharged ink quantity corresponding to the target print concentration ODc.

Figure 12:
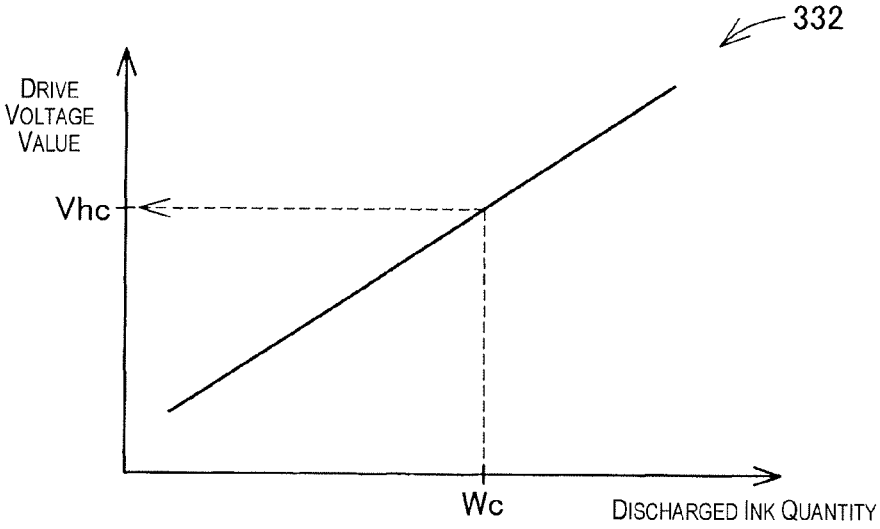
FIG. 12 is a schematic diagram for describing a process of establishing a drive voltage value after correction.

FIG. 12 is a schematic diagram for describing the process of establishing the drive voltage value after correction in step S50 (FIG. 9). FIG. 12 shows an example of the drive voltage value establishing map 332 (FIG. 2) used in step S50. In step S50, the concentration correction execution unit 25 reads the drive voltage value establishing map 332 from the ROM 33.

The drive voltage value establishing map 332 is a graph whose horizontal axis represents the discharged ink quantity and whose vertical axis represents the drive voltage values, and this graph shows the discharged quantity of pigment ink corresponding to the drive voltage value Vhp applied to the pigment ink nozzle 61Kp. The relationship shown by this drive voltage value establishing map 332 is a relationship obtained in advance by tests or the like, and is characteristic to the nozzle 61Kp.

The concentration correction execution unit 25 uses the drive voltage value establishing map 332 to acquire a post-correction drive voltage value Vhc, which is a drive voltage value corresponding to the target discharged ink quantity Wc acquired in step S40. The concentration correction execution unit 25 updates the value of an advancing drive voltage value $Vhp_1$ included in the pigment ink data 351*p* in the pulse voltage value data (FIG. 3C) stored in the EEPROM 35, and this value is updated to the post-correction drive voltage value Vhc (step S60), ending the print concentration correction process.

Figure 13A:
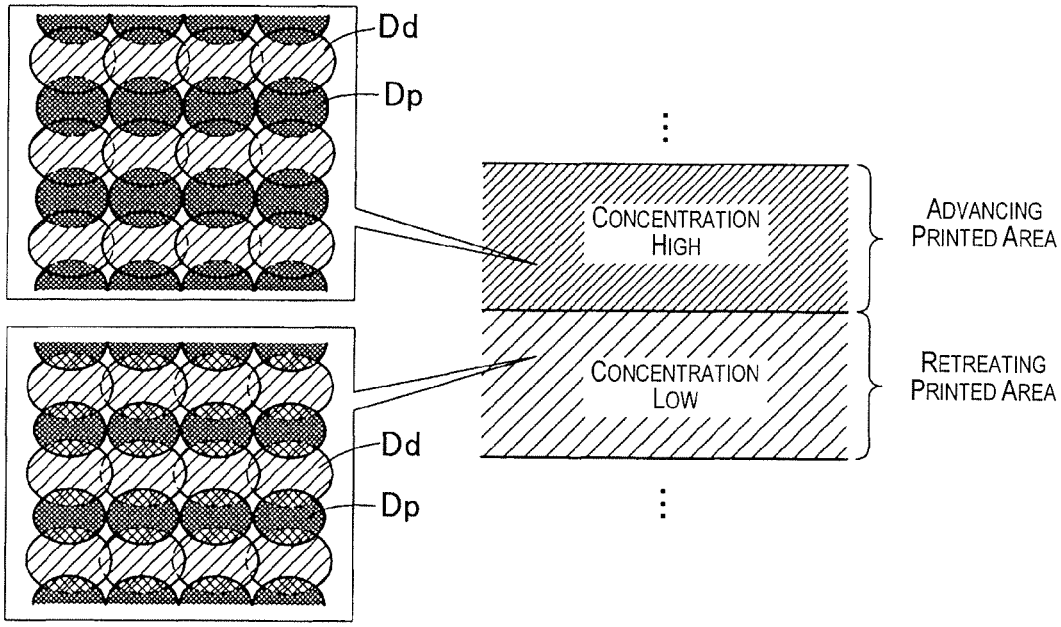
FIGS. 13A and 13B are schematic diagrams for describing the effects of the print concentration correction process.
Figure 13B:
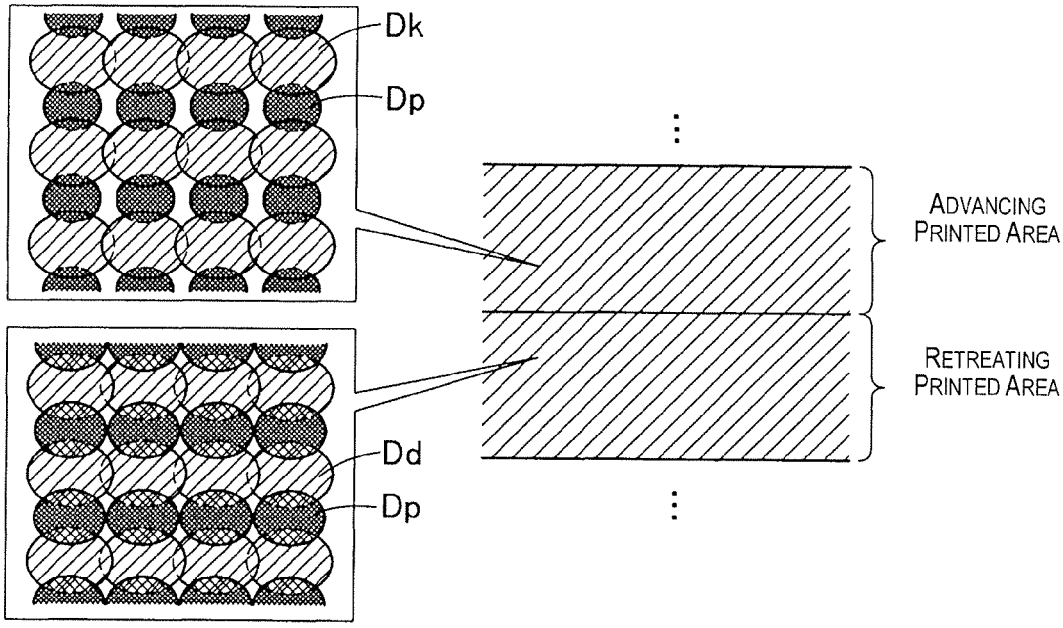

FIGS. 13A and 13B are schematic diagrams for describing the effects of the print concentration correction process. FIG. 13A is a schematic diagram showing the printing effects before the correction process is performed, and is substantially the same as FIG. 8C. In band printing in which a printed image of uniform concentration is created, a state is envisioned in which the advancing printed area has a higher concentration than the retreating printed area. FIG. 13B shows the effects of printing the same image as FIG. 13A after the print concentration correction process has been performed. FIG. 13B is substantially the same as FIG. 13A except that the concentration of the advancing printed area is lower and the size of the pigment ink dots Dp included in the advancing printed area has been reduced.

As previously described, in the printing device 100 of the present embodiment, the pigment ink data 351*p* in the pulse voltage value data 351 has an advancing drive voltage value $Vhp_1$ and a retreating drive voltage value $Vhp_2$. In the print concentration correction process, only the value of the advancing drive voltage value $Vhp_1$ of the pulse voltage value data 351 is corrected in step S60. Therefore, when band printing has been performed, the size of the pigment ink dots Dp formed by the advancing of the print head 60 is different from the size of the pigment ink dots Dp formed by the retreating of the print head 60.

In the example of FIGS. 13A and 13B, the size of the pigment ink dots Dp included in the advancing printed area is reduced by the print concentration correction process to be smaller than the size of the pigment ink dots Dp of the advancing printed area, and the concentration difference between the advancing printed area and the retreating printed area is resolved. When the concentration of the retreating printed area is higher than that of the advancing printed area, the opposite of the example of FIGS. 13A and 13B, the pigment ink dots Dp of the advancing printed area are adjusted so as to enlarge in size.

Thus, in the printing device 100 of the present embodiment, in the case in which concentration difference occurs between the advancing printed area and the retreating printed area during band printing using pigment ink and dye ink, the print concentration correction process is performed. The size of the pigment ink dots Dp is thereby adjusted, and the concentration difference can be reduced.

B. Second Embodiment

Figure 14:
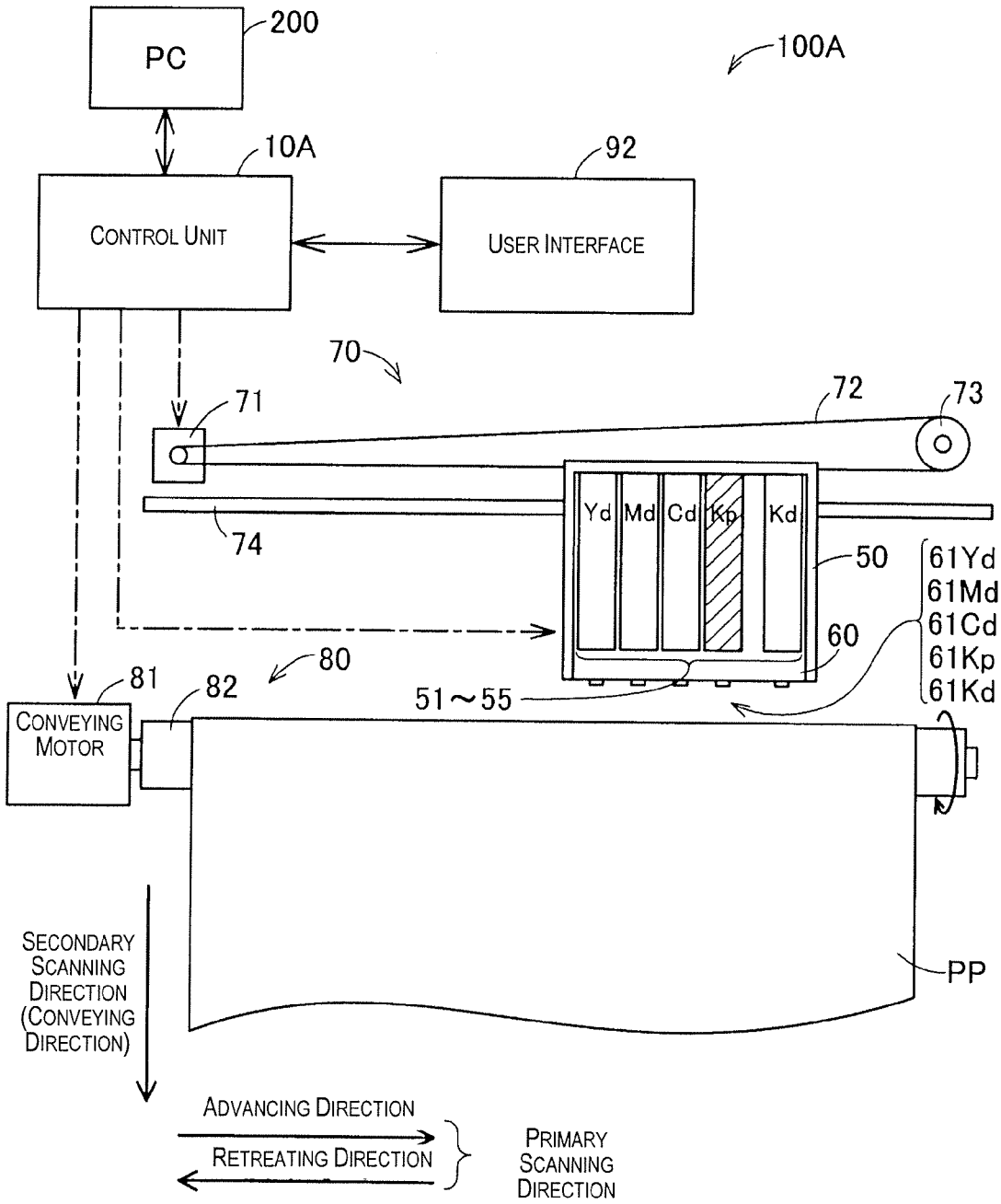
FIG. 14 is a schematic drawing showing the configuration of a printing device as a second embodiment.

FIG. 14 is a schematic drawing showing the configuration of a printing device 100A as a second embodiment of the present invention. FIG. 14 is substantially the same as FIG. 1 except that a user interface 92 is provided instead of the test pattern reading unit 90 and a control unit 10A is provided instead of the control unit 10. The user interface 92 is configured from a liquid crystal screen or another display unit for displaying information pertaining to the printing device 100A to the user, buttons for receiving user scans, and other components. The user interface 92 may also be configured from a touch panel, for example.

Figure 15:
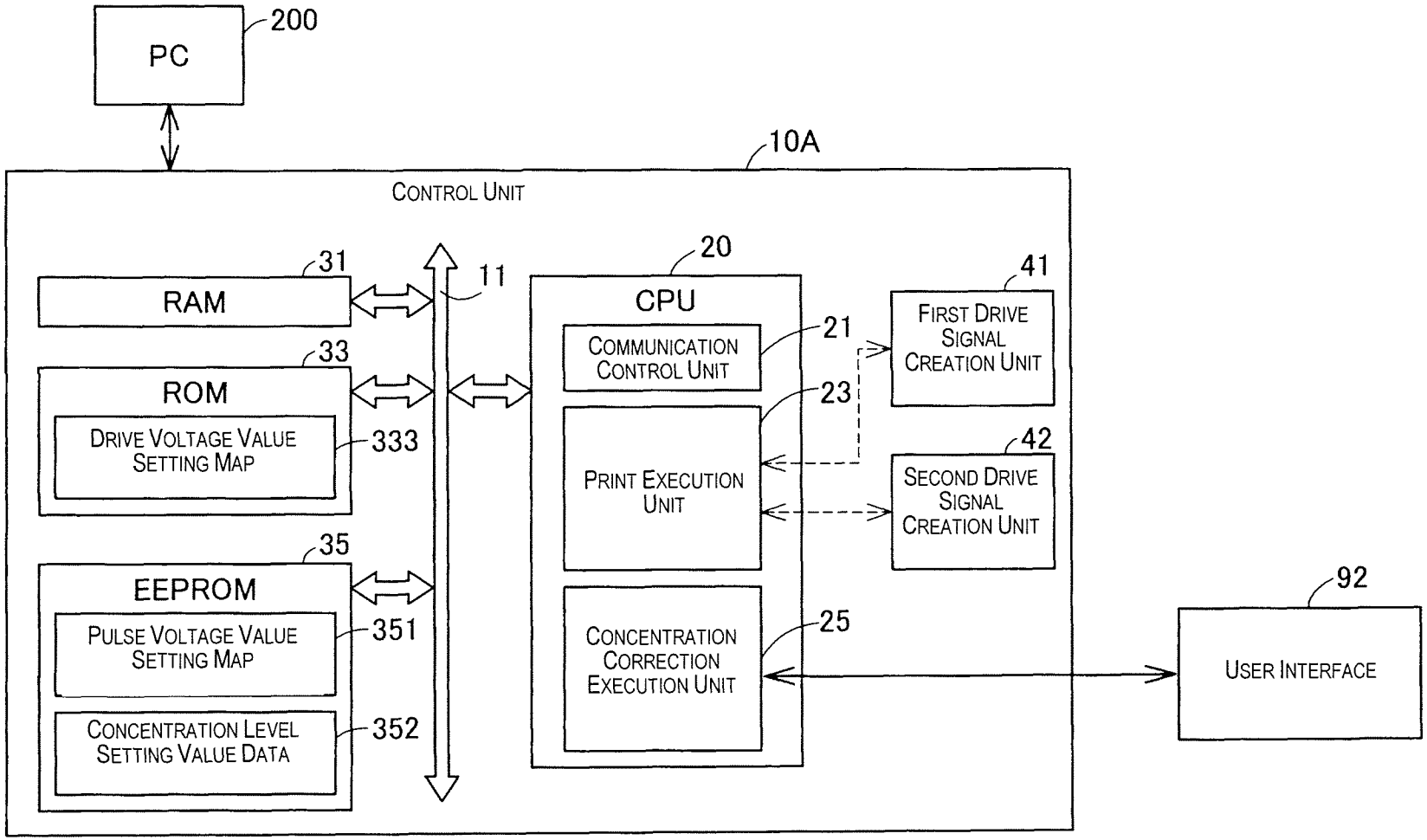
FIG. 15 is a schematic block diagram showing the internal configuration of a control unit of the second embodiment.

FIG. 15 is a schematic block diagram showing the internal configuration of the control unit 10A of the second embodiment. FIG. 15 is substantially the same as FIG. 2 except that the user interface 92 is provided instead of the test pattern reading unit 90, the map stored in the ROM 33 is different, and concentration level setting value data 352 has been added to the EEPROM 35. The configuration of the printing device 100A of the second embodiment is otherwise identical to that of the printing device 100 of the first embodiment. In the printing device 100A of the second embodiment, the concentration correction execution unit 25 does not measure the concentration of the test pattern TP, but uses a drive voltage value setting map 333 or the concentration level setting value data 352 to execute a print concentration correction process described hereinbelow.

Figure 16:
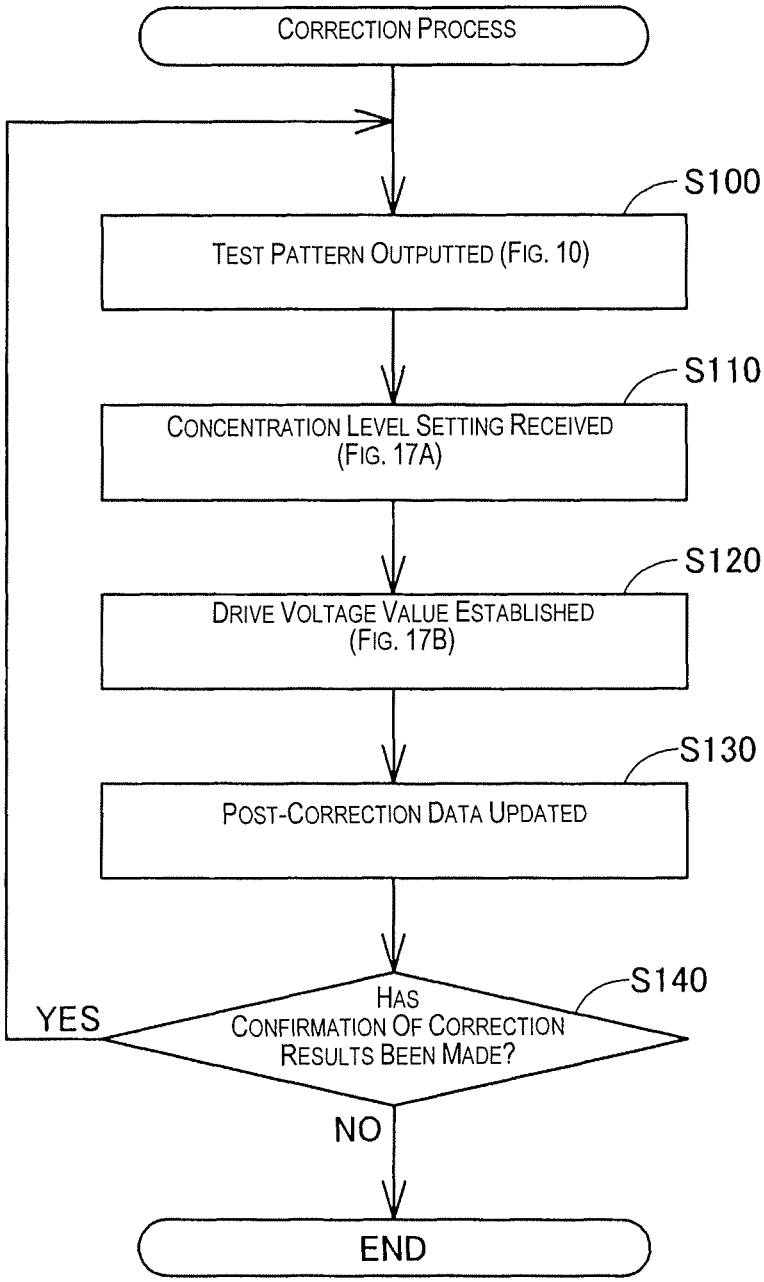
FIG. 16 is a flowchart showing the sequence of the print concentration correction process executed by the concentration correction execution unit of the second embodiment.

FIG. 16 is a flowchart showing the sequence of the print concentration correction process executed by the concentration correction execution unit 25 of the second embodiment. In step S100, the concentration correction execution unit 25 outputs the same test pattern TP (FIG. 10) as that described in the first embodiment to the print execution unit 23. In step S110, concentration level settings from the user are received via the user interface 92.

Figure 17A:
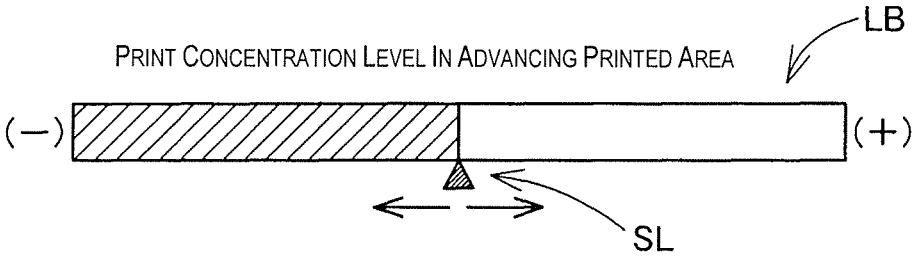
FIG. 17A is a schematic diagram showing an example of an image for the concentration level settings.

FIG. 17A is a schematic diagram showing an example of an image for setting the concentration level displayed on the user interface 92. In step S110, the user interface 92 displays a bar graph-shaped level bar LB showing the concentration level of the current advancing test image PA1, as well as a slider SL which the user can operate to move along the level bar LB on the screen. The concentration level is a setting value showing the extent of the print concentration of the printing device 100A, which is set as desired in advance. The concentration level is stored as the concentration level setting value data 352 in the EEPROM 35.

The user can inspect the concentration difference between the advancing test image PA1 and the retreating test image PA2 in the outputted test pattern TP, and can move the slider SL according to the concentration difference. The user can then specify the post-correction concentration level DLc of the advancing test image PA1 in accordance with the moving amount of the slider SL. Specifically, when the concentration of the advancing test image PA1 has been determined to be high, by moving the slider SL in the −direction, the user can correct the concentration level so as to decrease by the amount the slider SL moves. When it has been determined that the concentration of the advancing test image PA1 is low, by moving the slider SL in the +direction, the user can correct the concentration level so as to increase by the amount the slider SL moves.

Figure 17B:
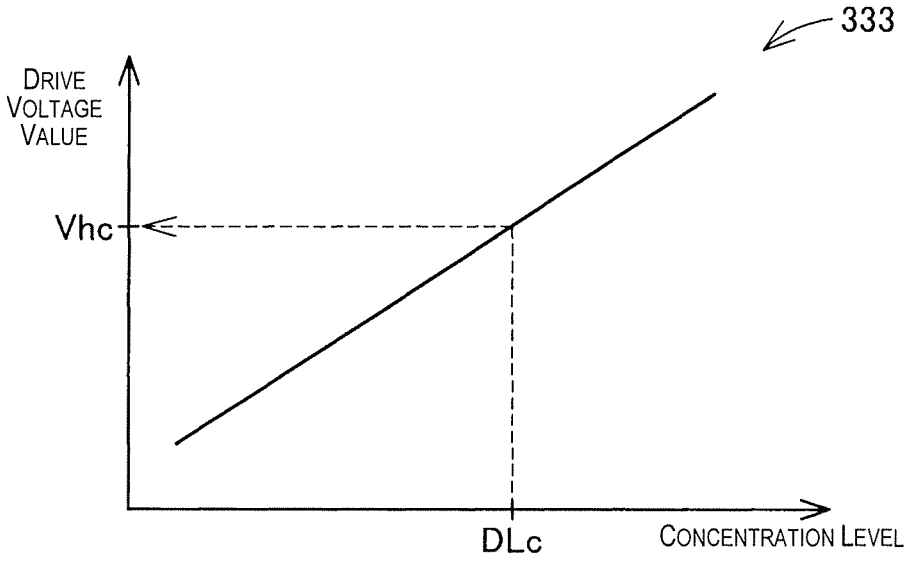
FIG. 17B is a schematic diagram for describing the process of establishing the post-correction drive voltage value.

FIG. 17B is a schematic diagram for describing the process of establishing the post-correction drive voltage value in step S120. FIG. 17B shows an example of the drive voltage value setting map 333 used in step S120. In step S120, the concentration correction execution unit 25 reads the drive voltage value setting map 333 from the ROM 33.

The drive voltage value setting map 333 is a graph whose horizontal axis represents the concentration level and whose vertical axis represents the drive voltage value. The drive voltage value setting map 333 is set in advance by testing or the like. The drive voltage value setting map 333 shows the correspondence relationship between the concentration level of the advancing test image PA1 and the drive voltage value of the drive signal applied to the nozzles for creating the pigment ink dots constituting the advancing test image PA1. The concentration correction execution unit 25 uses the drive voltage value setting map 333 to acquire the post-correction drive voltage value Vhc, which is a drive voltage value corresponding to the post-correction concentration level DLc received from the user in step S110.

In step S130, the concentration correction execution unit 25 updates the value of the advancing drive voltage value $Vhp_1$ included in the pigment ink data 351*p* in the pulse voltage value data 351 (FIG. 3C) stored in the EEPROM 35, the value being updated to the post-correction drive voltage value Vhc. The size of the pigment ink dots formed in the advancing printed area is thereby adjusted according to the concentration level DLc specified by the user. Specifically, the concentration level in the printing device 100A of the present embodiment is an adjustment value for adjusting the size of the pigment ink dots.

In step S140, the concentration correction execution unit 25 makes an inquiry of whether or not to confirm the correction results to the user via the user interface 92. When an operation for confirming the correction results has been received from the user, the concentration correction execution unit 25 again outputs the test pattern TP to the print execution unit 23 (step S100). The print execution unit 23 then receives the concentration level settings from the user based on the re-outputted test pattern TP (step S110). In step S140, when an operation has been received to the effect that the user does not desire confirmation of the correction results, the print concentration correction process ends.

Thus, according to the printing device 100A of the second embodiment, the concentration of the advancing printed area in band printing can be adjusted by an operation by the user, and the concentration difference between the advancing printed area and the retreating printed area can be reduced.

C. Modifications

The present invention is not limited to the working examples and embodiments described above, and various other aspects can be implemented within a range that does not deviate from the scope of the invention. For example, the following such modifications can be made.

C1. Modification 1

In the embodiments described above, some of the configuration implemented through hardware may be replaced with software, and conversely, some of the configuration implemented through software may be replaced with hardware. For example, it is also possible for some of the functions of the concentration correction execution unit 25 to be performed by other hardware or by the print execution unit 23.

C2. Modification 2

In the print concentration correction process of the embodiments described above, the ink quantity discharged from the nozzles is adjusted by adjusting the voltage applied to the nozzles, thereby varying the size of the pigment ink dots Dp created in the advancing printed area in band printing and adjusting the concentration of the printed image. However, in the print concentration correction process, the size of other ink dots may be adjusted as well. For example, the size of the dye ink dots Dd constituting the advancing printed area in band printing may be adjusted. The size of the pigment ink dots Dp or the size of the dye ink dots Dd constituting the retreating printed area may also be adjusted.

C3. Modification 3

In the printing device 100 of the first embodiment, the post-correction drive voltage value Vhc was acquired based on the concentration $OD_1$ measured from the test pattern TP by using the discharged ink quantity correction map 331 and the drive voltage value establishing map 332. It is also possible to create in advance a single map showing the correspondence relationship between the discharged ink quantity and the drive voltage value by combining the discharged ink quantity correction map 331 and the voltage value establishing map 332. The concentration correction execution unit 25 may use a map showing the correspondence relationship prepared in advance to acquire the post-correction drive voltage value Vhc on the basis of the measured concentration $OD_1$.

C4. Modification 4

In the embodiments described above, the printing device 100 used black pigment ink for printing. However, the printing device 100 may print using pigment ink of a color other than black either instead of black or in addition to black. In this case, a size adjustment may be performed also on pigment ink dots of a different color than the black pigment ink dots Dp during the print concentration correction process (FIG. 9).

C5. Modification 5

In the embodiments described above, the first and second drive signal both had upward convex pulses Pd1, Pp1 and downward convex pulses Pd2, Pp2. However, there are cases of the printing device having a drive pulse for each size, i.e., large, medium, and small, in order to form ink dots of the different sizes large, medium, small, and so forth. In the print concentration correction process in this case, a drive voltage value correction may be performed on any one desired drive pulse from among a plurality of drive pulses, and corrections of the drive voltage values of other drive pulses may be performed according to the first correction amount. As another option, a drive voltage value correction may be performed for each ink dot size. Specifically, the correspondence relationship between the concentration per unit surface area of the image configured from ink dots of various sizes and the drive voltage value for creating the ink dots (i.e. the correspondence relationship for the ink dots of each size) is prepared in advance. These correspondence relationships may be used to perform a drive voltage value correction on the ink dots of the different sizes.

C6. Modification 6

In the embodiments described above, the pulse voltage value data 351 of the printing device 100 included drive voltage value data 351*d*, 351*p* for each ink type. However, the pulse voltage value data 351 may be further provided with drive voltage value data corresponding to the type of paper PP, and drive voltage value data corresponding to the type of ink color. Adjustments for correcting concentration may be made for each of these types of drive voltage value data.

C7. Modification 7

In the first embodiment described above, the test pattern TP was provided with an advancing test image PA1 and a retreating test image PA2 for a single concentration. However, the test pattern TP may be further provided with test images for a plurality of concentrations.

C8: Modification 8

In the second embodiment, the print concentration was corrected using the concentration level specified by the user and the drive voltage value setting map 333, but the print concentration correction process need not use the concentration level or the drive voltage value setting map 333. The print concentration correction process may be performed using an adjustment value set as desired in advance in order to adjust the ink dot size, and the correspondence relationship between this adjustment value and the voltage value of the drive voltage applied to the nozzles.

C9. Modification 9

In the embodiments described above, the printing devices 100, 100A acquired print data from the personal computer 200. However, the printing devices 100, 100A may acquire the print data from an external storage device attached externally, a digital camera, or another device.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing method for a printing device which uses ink including pigment ink and dye ink to form a printed image on a print medium, and which discharges an ink quantity according to a voltage value of a drive voltage to form ink dots on the print medium, the method comprising:

forming a first image on the print medium by using the printing device to perform a first ink dot creation process for forming pigment ink dots and then forming dye ink dots adjacent to the pigment ink dots;

forming a second image on the print medium by using the printing device to perform a second ink dot creation process for forming dye ink dots and then forming pigment ink dots adjacent to the dye ink dots;

measuring the respective concentrations of the first image and the second image by concentration measurement means; and correcting a voltage value of a drive voltage to create the pigment ink dots so that a difference between the concentration of the first image and the concentration of the second image is reduced, while maintaining a voltage value of a drive voltage to create the dye ink dots stationary.

2. The method according to claim 1, wherein the correcting of the voltage value of the drive voltage to create the pigment ink dots includes correcting the voltage value of the drive voltage to create the pigment ink dots during forming the first image, while maintaining the voltage value of the drive voltage to create the pigment ink dots during forming the second image stationary.

3. The method according to claim 1, further comprising calculating a difference value indicating the difference between the concentration of the first image and the concentration of the second image, and determining whether the calculated difference value is greater than a predetermined value, wherein the correction of the voltage value of the drive voltage to create the pigment ink dots is preformed when the calculated difference value is greater than the predetermined value.

4. A printing device comprising:

nozzles configured and arranged to discharge ink to form ink dots on a print medium, the ink including pigment ink and dye ink, the nozzles including pigment ink nozzles for forming pigment ink dots and dye ink nozzles for forming dye ink dots;

a nozzle control unit configured to control size of the ink dots by controlling a voltage value of a drive voltage and to control ink quantities discharged from the nozzles; and a storage unit configured to store a correspondence relationship between an adjustment value for adjusting the size of the ink dots and the voltage value of the drive voltage, the nozzle control unit being configured to perform a first printing process for forming pigment ink dot rows and dye ink dot rows adjacent to each other by causing the pigment ink nozzles to form pigment ink dots and then causing the dye ink nozzles to form dye ink dots adjacent to the pigment ink dots, and a second printing process for forming dye ink dot rows and pigment ink dot rows adjacent to each other by causing the dye ink nozzles to form dye ink dots and then causing the pigment ink nozzles to form pigment ink dots adjacent to the dye ink dots, so that a printed image including first and second printed image areas is formed respectively by the first and second printing processes, and in the first and second printing processes, the nozzle control unit being configured to use the adjustment value and the correspondence relationship to vary a voltage value of a drive voltage to create the pigment ink dots while maintaining a voltage value of a drive voltage to create the dye ink dots stationary, so that a difference between the concentration of the first printed image area and the concentration of the second printed image area is reduced.

5. The printing device according to claim 4, further comprising a print head which has pigment ink nozzle rows and dye ink nozzle rows parallel to each other in which the pigment ink nozzles and the dye ink nozzles are aligned in a aligned direction at a prescribed nozzle pitch, and which moves back and forth in first and second directions that intersect the alignment direction of the pigment ink nozzle rows and the dye ink nozzle rows, the pigment ink nozzle rows and the dye ink nozzle rows being disposed in the print head such that the pigment ink nozzle rows are nearer the first direction and the dye ink nozzle rows are nearer the second direction, the pigment ink nozzles and the dye ink nozzles being offset from each other in the alignment direction, the first printing process including a process for printing the first printed image area while moving the print head in the first direction, the second printing process including a process for printing the second printed image area while moving the print head in the second direction, and the nozzle control unit being configured to form the printed image on the print medium by alternately performing the first and second printing processes.

6. A printing method of a printing device including nozzles for discharging ink to form ink dots on a print medium the ink including pigment ink and dye ink, the nozzles including pigment ink nozzles for forming pigment ink dots and dye ink nozzles for forming dye ink dots, a nozzle control unit for controlling the size of the ink dots by controlling a voltage value of a drive voltage and controlling the ink quantities discharged from the nozzles, and a storage unit for storing a correspondence relationship between an adjustment value for adjusting the size of the ink dots and the voltage value of the drive voltage, the printing method comprising:

performing a first printing process for forming a first printed image area composed of pigment ink dot rows and dye ink dot rows adjacent to each other by causing the pigment ink nozzles to form pigment ink dots and then causing the dye ink nozzles to form dye ink dots adjacent to the pigment ink dots;

performing a second printing process for forming a second printed image area composed of dye ink dot rows and pigment ink dot rows adjacent to each other by causing the dye ink nozzles to form dye ink dots and then causing the pigment ink nozzles to form pigment ink dots adjacent to the dye ink dots; and performing a process within the first or second printing process in which the adjustment value and the correspondence relationship are used to vary a voltage value of a drive voltage to create the pigment ink dots while maintaining a voltage value of a drive voltage to create the dye ink dots stationary, so that a difference between the concentration of the first printed image area and the concentration of the second printed image area is reduced.

7. The printing method according to claim 6, wherein the printing device includes a print head which has pigment ink nozzle rows and dye ink nozzle rows parallel to each other in which the pigment ink nozzles and the dye ink nozzles are aligned in an alignment direction at a prescribed nozzle pitch, and which moves back and forth in first and second directions that intersect the alignment direction of the pigment ink nozzle rows and the dye ink nozzle rows, the pigment ink nozzle rows and the dye ink nozzle rows are disposed in the print head such that the pigment ink nozzle rows are nearer the first direction and the dye ink nozzle rows are nearer the second direction, the pigment ink nozzles and the dye ink nozzles being offset from each other in the alignment direction, the first printing process includes a process for printing the first printed image area while moving the print head in the first direction, the second printing process includes a process for printing the second printed image area while moving the print head in the second direction, and a printed image is formed on the print medium by alternately performing the first and second printing processes.

* * * * *